US007017307B2

(12) United States Patent
Jones et al.

(10) Patent No.: US 7,017,307 B2
(45) Date of Patent: Mar. 28, 2006

(54) STRUCTURES

(75) Inventors: Dennis Anthony Jones, Nantwich (GB); Colin Antony Jones, Llandudno (GB)

(73) Assignee: Wrenbury Hall Limited, Nantwich (GB)

( * ) Notice: Subject to any disclaimer, the term of this patent is extended or adjusted under 35 U.S.C. 154(b) by 0 days.

(21) Appl. No.: 10/209,501

(22) Filed: Jul. 31, 2002

(65) Prior Publication Data

US 2003/0024175 A1 Feb. 6, 2003

(30) Foreign Application Priority Data

| | | |
|---|---|---|
| Aug. 1, 2001 | (GB) | 0118713 |
| Aug. 1, 2001 | (GB) | 0118715 |
| Aug. 1, 2001 | (GB) | 0118716 |
| Aug. 4, 2001 | (GB) | 0119047 |
| Aug. 4, 2001 | (GB) | 0119048 |
| Oct. 16, 2001 | (GB) | 0124767 |
| Dec. 20, 2001 | (GB) | 0130632 |
| Feb. 16, 2002 | (GB) | 0203749 |
| Jul. 22, 2002 | (GB) | 0216970 |
| Jul. 22, 2002 | (GB) | 0216971 |

(51) Int. Cl.
*E04B 7/02* (2006.01)

(52) U.S. Cl. ..... 52/90.1; 52/200; 52/57; 52/82; 52/DIG. 17

(58) Field of Classification Search ..... 52/204.593, 52/204.69, 282.1, 91.1, 92.1, 92.3, 93.2, 52/460, 461, 90.1, 200, 57, 82, DIG. 17
See application file for complete search history.

(56) References Cited

U.S. PATENT DOCUMENTS

| | | | | |
|---|---|---|---|---|
| 2,213,402 | A * | 9/1940 | Lowry | 52/204.57 |
| 3,844,087 | A * | 10/1974 | Schultz et al. | 52/200 |
| 4,015,388 | A * | 4/1977 | Hemminger | 52/395 |
| 4,251,964 | A * | 2/1981 | Francis | 52/204.593 |
| 4,261,143 | A | 4/1981 | Rizzo | |
| 4,756,127 | A * | 7/1988 | Helterbrand et al. | 52/93.1 |
| 4,850,167 | A * | 7/1989 | Beard et al. | 52/200 |
| 4,996,802 | A * | 3/1991 | Brown | 52/92.2 |
| 5,363,615 | A * | 11/1994 | Christopher et al. | 52/272 |
| 5,481,839 | A * | 1/1996 | Lang et al. | 52/235 |
| 5,568,707 | A * | 10/1996 | Ishikawa et al. | 52/200 |

(Continued)

FOREIGN PATENT DOCUMENTS

DE 2540325 3/1977

(Continued)

*Primary Examiner*—Naoko Slack
(74) *Attorney, Agent, or Firm*—Bracewell & Giuliani LLP

(57) ABSTRACT

A ridge end assembly for a hipped roof is disclosed in which panel-supporting elongate members of the hipped roof are connected to the ridge end by connectors which are provided with means for locating lengths of sealing material betwen panels supported, in use, by the panel supporting members and an overlying ridge end cap.

In one embodiment, the ridge assembly can include a ridge structure, a ridge cap for fitting atop the ridge structure, the ridge cap having a channel at its underside, and at least one fastener having an enlarged part for reception and retention in the channel, the fastener comprising a flexible tie by means of which the cap can be drawn into place on the ridge structure and then secured by a locking member co-operating with the tie.

In another embodiment, a roofing structure comprises an eaves structure, glazing bars supported on the eaves structure, one or more roofing panels supported by the glazing bars and an end fitting including a portion overlying one end of the roofing panel and coupled to the eaves structure to prevent lifting of the roofing panels.

17 Claims, 15 Drawing Sheets

U.S. PATENT DOCUMENTS

| | | | | | |
|---|---|---|---|---|---|
| 5,927,027 | A | * | 7/1999 | Richardson | 52/200 |
| 6,000,176 | A | * | 12/1999 | Lancaster | 52/198 |
| 6,082,071 | A | * | 7/2000 | Richardson | 52/718.04 |
| 6,141,923 | A | * | 11/2000 | Habicht et al. | 52/235 |
| 6,151,845 | A | | 11/2000 | Lancaster | |
| 6,185,880 | B1 | * | 2/2001 | Richardson | 52/198 |
| 6,223,481 | B1 | * | 5/2001 | Rickman | 52/90.1 |
| 6,260,307 | B1 | * | 7/2001 | Richardson | 52/11 |
| 6,389,770 | B1 | * | 5/2002 | Santavicca | 52/474 |
| 6,405,504 | B1 | * | 6/2002 | Richardson | 52/461 |
| 6,460,309 | B1 | * | 10/2002 | Schneider | 52/729.1 |
| 6,523,311 | B1 | * | 2/2003 | Edger | 52/204.593 |
| 6,553,739 | B1 | * | 4/2003 | Richardson | 52/734.2 |
| 6,631,594 | B1 | * | 10/2003 | Whiting | 52/204.69 |

FOREIGN PATENT DOCUMENTS

| | | | | |
|---|---|---|---|---|
| DE | 2540326 | | | 3/1977 |
| DE | 2752285 | | | 5/1979 |
| DE | 3640489 | | | 6/1986 |
| DE | 4121656 | | | 6/1991 |
| DE | 19922239 | A1 | | 11/2000 |
| EP | 0075509 | | | 3/1983 |
| EP | 0146376 | | | 6/1985 |
| EP | 0213521 | | | 3/1987 |
| EP | 0369508 | | | 5/1990 |
| EP | 0649969 | | | 4/1995 |
| EP | 0794297 | | | 9/1997 |
| EP | 0821116 | | | 1/1998 |
| FR | 2637647 | | | 4/1980 |
| GB | 0572247 | | | 11/1943 |
| GB | 0677014 | | | 8/1952 |
| GB | 0796176 | | | 6/1958 |
| GB | 1011881 | | | 12/1965 |
| GB | 1056800 | | | 1/1967 |
| GB | 1166489 | | | 10/1969 |
| GB | 1253835 | | | 11/1971 |
| GB | 1433218 | | | 4/1976 |
| GB | 1520585 | | | 8/1978 |
| GB | 1520585 | A | | 8/1978 |
| GB | 1545486 | | | 5/1979 |
| GB | 1585930 | | | 3/1981 |
| GB | 2104124 | | | 3/1983 |
| GB | 2135707 | | | 9/1984 |
| GB | 2141168 | | | 12/1984 |
| GB | 2196047 | A | | 4/1988 |
| GB | 2204627 | | | 11/1988 |
| GB | 2212183 | | | 7/1989 |
| GB | 2214964 | | | 11/1989 |
| GB | 2256880 | | | 2/1992 |
| GB | 2218127 | | | 12/1992 |
| GB | 2256658 | | | 12/1992 |
| GB | 2259926 | | | 3/1993 |
| GB | 2287048 | | | 4/1993 |
| GB | 2261237 | | | 5/1993 |
| GB | 2284836 | | | 6/1995 |
| GB | 2287493 | | | 9/1995 |
| GB | 2291096 | | | 1/1996 |
| GB | 2273114 | | | 5/1996 |
| GB | 2284836 | | | 12/1996 |
| GB | 2311308 | | | 9/1997 |
| GB | 2321260 | A | | 7/1998 |
| GB | 2323396 | | | 9/1998 |
| GB | 2332687 | | | 3/1999 |
| GB | 2335673 | | | 9/1999 |
| GB | 2335673 | A | | 9/1999 |
| GB | 2336608 | | | 10/1999 |
| GB | 2310869 | | | 5/2000 |
| GB | 2337778 | | | 5/2000 |
| GB | 2347948 | A | | 9/2000 |
| GB | 2347963 | | | 9/2000 |
| GB | 2347963 | A | * | 9/2000 |
| GB | 2357783 | | | 7/2001 |
| GB | 2361251 | | | 10/2001 |
| WO | WO 9101419 | | | 2/1991 |
| WO | WO 9325779 | | | 12/1993 |
| WO | WO 0157336 | | | 8/2001 |

* cited by examiner

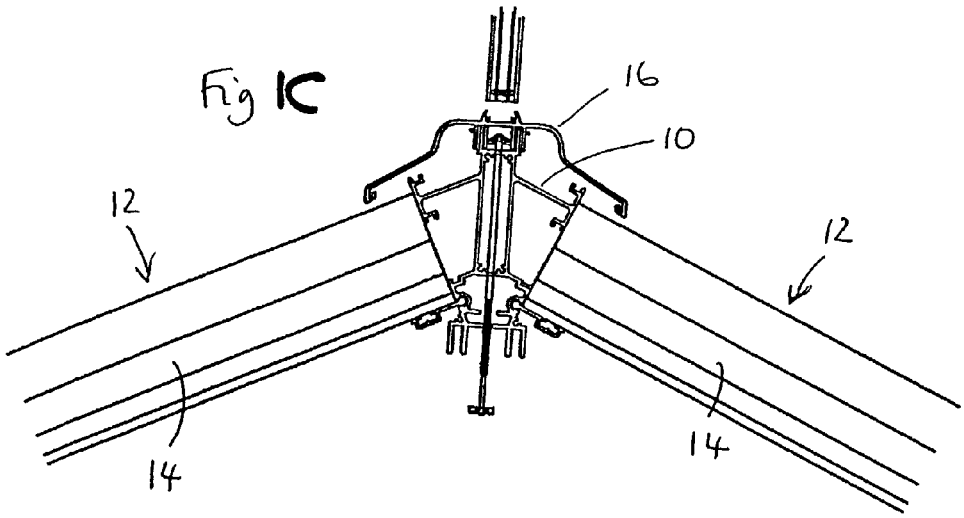
Fig 1C
16
10
12
12
14
14
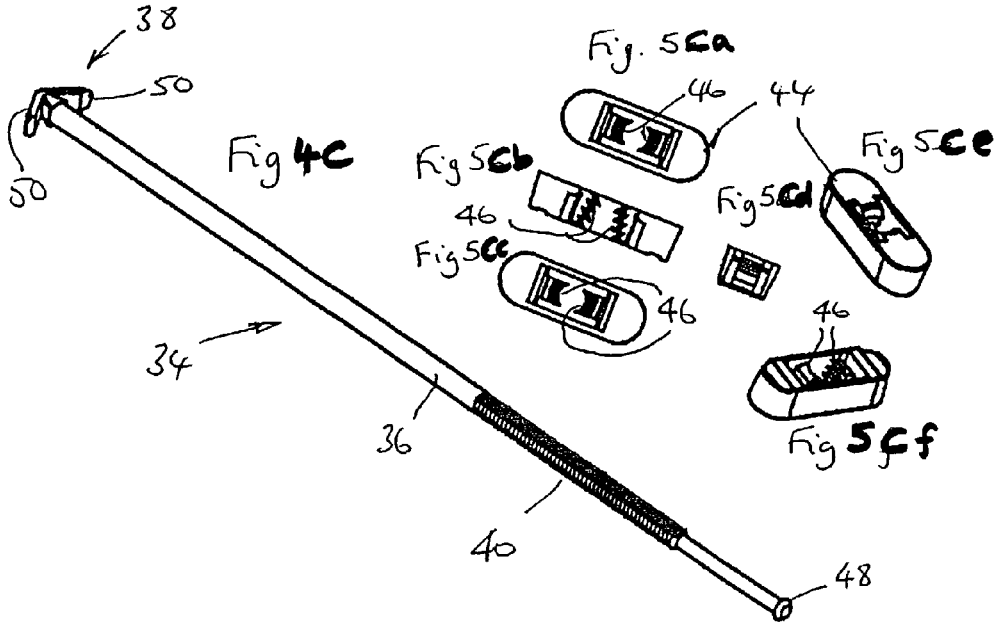
38
50
50
Fig 4C
34
36
40
48
Fig. 5Ca
46
44
Fig 5Cb
46
Fig 5Cc
46
Fig 5Cd
Fig 5Ce
46
Fig 5Cf

STRUCTURES

STRUCTURES

The present invention relates to improvements in roof structures and components, especially for conservatories. Other aspects of the invention are concerned with structural features of conservatories.

Hipped Roof Features

A first aspect of the present invention is concerned with roof ridge assemblies, especially for conservatories of the hipped type in which panel supporting bars radiate from one end of a ridge structure, the supporting bars being connected between the ridge end and an eaves beam and the ridge end being provided with a cap overlying the end portions of the supporting bars.

In known arrangements, to prevent ingress of rainwater etc beneath the cap, flexible foamed material is pushed into the gap between the cap and the underlying roofing in a somewhat haphazard and unreliable manner.

This aspect of the present invention seeks to provide, inter alia, a more reliable sealing arrangement for the ridge end construction.

The present invention resides in a ridge end assembly for a hipped roof in which panel-supporting elongate members of the hipped roof are connected to the ridge end by connectors which are provided with means for locating lengths of sealing material between the panels supported, in use, by the panel supporting members and an overlying ridge end cap.

The lengths of sealing material may be in the form of strips located with one edge contacting the panels and the opposite edge contacting or in close proximity to the underside of the cap.

The lengths of sealing material may be located at a position at or immediately adjacent a lower edge of the ridge end cap so as to intercept rainwater at the opening between the panels and the ridge end cap.

The invention also resides in a connector for use in connecting panel-supporting bars to the ridge end of a hipped roof, the connector being provided with a formation for coupling to a mounting element associated with the ridge end and locating means for positioning strips of sealing material between the panels and an overlying ridge end cap.

The strips may have sealing contact at least with the panels and, optionally, with the ridge end cap so as to achieve weatherproofing to a substantial extent, especially with respect to ingress of rainwater.

The locating means may form part of the connectors or, alternatively, may be provided on separate components which are adapted to be fitted to the connectors.

The locating means may be formed by spaced flanges which extend substantially transversely to the panel-supporting members, the flanges being arranged so that a section of the sealing material can be inserted in and retained in position by the flanges.

At least one of the flanges may be provided with an upstanding flexible sealing gasket for co-operation with the overlying ridge end cap.

The connectors may be provided with drainage channels for directing any water penetrating beneath the cap to channels provided on the supporting bars.

The drainage channels may be provided directly on the connectors or, alternatively, on separate components adapted to be fitted to the connectors, which components will usually be the same components as referred to above but the possibility of different components being used is not excluded.

The drainage channels may be formed by lateral extensions which may be arranged to contact the undersides of the panels in the proximity of the ridge end.

For the avoidance of doubt, it is contemplated that the provision of a connector with a drainage channel or channels as disclosed herein may constitute a separate aspect or aspects of the invention which are not necessarily limited to use in combination with the locating means.

The extensions may be provided with gaskets for sealing contact with the undersides of the panels.

The flanges and/or the extensions may be integrally formed with the connectors.

Each connector may be provided with a hook-shaped formation for connection to an arcuate mounting element associated with the ridge end.

Enhanced Security Roof Structure Features

The subject matter of the present application includes an improved roof structure; in particular, one which affords greater security against thieves making entry through the roof of a conservatory or the like by removing one or more panels.

This may be embodied in a roof structure comprising a ridge, an eaves beam, spaced apart glazing bars extending between the ridge and the eaves beam and roofing panels supported by the glazing bars, characterised in that to provide security against removal of the roof panels: each glazing bar comprises an inner elongate member which has at least one shoulder providing support for the inner face of an edge of a roofing panel and at least one outer elongate member for co-operation with the inner member and, in use, overlies an outer face of the roofing panel edge, the inner and outer elongate members being so arranged that lifting of the panels is prevented by (a) the members being coupled together by fastening means operable from the inner member side of the glazing bar and/or (b) means associated with the inner member for obstructing lifting of the panel independently of the outer member(s) in such a way as to maintain the panel captive against lifting from the inner member after the outer member has been removed; and the lower edge of at least one the panels is provided with an end fitting including a portion overlying one end of the roofing panel to prevent that end of the panel being lifted.

In this manner, it is possible to locate the panels between the inner and outer members and because the fastening means is not operable or accessible from the side of the assembly on which the outer member is located, greater security is afforded against break-in to a conservatory or the like by removal of a roof panel or panels. This is in contrast with the glazing bar assembly of British Patent Application No. 2347963 where break-in can simply effected easily by levering the capping from the bar and then removing one or more roofing panels.

The end fitting serves to prevent access to the lower end of the roofing panel and, in conjunction with the arrangement of the glazing bars affords enhanced security against break-in because, usually the other end of the roofing panel or panels extend to a ridge structure part of which overlies that end of the roofing panel(s) resulting, by virtue of the present invention, in both ends of the panel being trapped at the ridge and eaves structures thereby further obstructing any attempt to remove the panel(s).

A glazing bar suitable for use in the above-defined enhanced security roof structure may have one or more of the following features in any combination where the context admits:

a. there may be just one outer member but the possibility of there being more than one is not excluded.
b. the inner and outer members may be fabricated as extruded profiles, e.g. of aluminium or aluminium alloy or of a plastics material.
c. the inner and outer members are each formed with a channel defined by spaced walls and arranged in such a way that they interfit in telescopic fashion.
d. the fastening means is accommodated within the intermitting channels.
e. the fastening means includes a tension-transmitting element.
f. the fastening means includes complementary screwthreaded portions.
g. one of the complementary portions co-operates with the underside of the inner member in use and is operable to draw the inner and outer members together.
h. the fastening means comprises one component for locating the same relative to the outer member and such component is concealed within the glazing bar assembly so as to be inaccessible from the outside of the roofing structure in use.
i. the fastening means comprises a bolt and nut set.
j. the fastening means comprises a self-tapping fastener.
k. one component of the bolt and nut set is captive with the outer member and the other component co-operates with the underside of the inner member.
l. two or more fastening means are provided at spaced intervals along the length of the glazing bar.
m. the inner member is generally T-shaped comprising a hollow central portion in which the fastening means is accommodated.
n. the outer member is generally V-shaped, the arrangement being such that the hollow central portion of the inner member extends into the V-shaped outer member.
o. the outer member includes a fastener-locating housing for receiving an enlarged part the fastening means.

A glazing bar having any one or more of the foregoing features a.–o. is considered to constitute an invention in its own right and the applicant reserves the right to seek protection thereof without limitation to other features disclosed in this specification.

The glazing bars may be arranged to support the panels on each side thereof and obstructing means may be associated with each side of the glazing bar.

This may be embodied in a glazing bar assembly comprising an inner elongate member which has at least one shoulder for providing support for the inner face of an edge of a roofing panel and at least one outer elongate member which co-operates with the inner member and, in use, overlies an outer face of the roofing panel edge, means being associated with the inner member for obstructing lifting of the panel independently of the outer member(s) in such a way as to maintain the panel captive against lifting from the inner member after the outer member has been removed.

Features which may pertain to the obstructing means include one or more of the following, which features may, where the context admits, be employed in any combination and also in any combination with any one or more of features a.–o. above.

a. said obstructing means comprises at least one channel-section element for receiving a side edge of a panel.
b. the channel-section element may be retained in place relative to the inner member at a location or locations beneath the panel(s) whereby external access to such location(s) is obstructed by the presence of the panel.
c. the channel-section element(s) may be of extruded form.
d. the channel-section element(s) may be attachable to the inner member.
e. the panel-obstructing means may be coupled to the outer member.
f. the point(s) of attachment may be located so as to be concealed from access outboard of the panel(s).
g. there may be a channel-section element associated with each side of the glazing bar and the elements may be arranged to be coupled to one another inboard of the panels.
h. the inner member may be of generally T section with a central stem which fits between the side edges of adjacent panels and a cross-piece which underlies the and provides support for the panel side edges, and the outer member may be of V-section and arranged to be connected to the free end of the stem of the T section so that the sides of the V project towards the cross-piece of the T and the or each channel-section element may be arranged to fit between the cross-piece of the inner member and the sides of the V with the mouth of the channel presented laterally in a direction away from the stem of the T.

A glazing bar having any one or more of features a.–h. aforesaid is considered to constitute another aspect of the invention and the applicant reserves the right to seek protection thereof without limitation to other features disclosed herein.

The enhanced security roof structure may have the following additional features which may be present in combination with one or more of the glazing bar features a.–o. above and/or one or more of features a to h of the obstructing means as specified above:

a. the end fitting may include a portion overlying one end of the roofing panel and coupled to the eaves structure internally of the outer face of the latter.
b. the end fitting being connected to the eaves structure through male and female connector parts which are arranged to be coupled together by push insertion of the male part into the female part in a direction transverse to the eaves structure in such a way that the male part is captive against withdrawal in the opposite direction to insertion. For the avoidance of doubt, the phrase "captive against withdrawal" as used in this specification is not to be interpreted in a strict literal sense irrespective of the force exerted in attempting to withdraw the male part; rather it is to be interpreted as meaning that withdrawal is not possible without damaging one or other part or both, e.g. to the extent that it is no longer possible to reassemble them together with the male part held captive within the female part.
c. the male part is rendered captive by a formation or formations located in vicinity of the entry opening to the female part.
d. the blocking formation(s) being provided on the female part.
e. the blocking formation(s) being provided in the vicinity of the entry opening of the female part.
f. the male part includes a pair of oppositely directed wing portions which can deflect towards one another to allow insertion through an entry opening of the female part but which restore once inserted and block withdrawal of the male part.

g. the blocking action is implemented by co-operation between the wing portions e.g. the free ends thereof, and the margins of the entry opening or one or more formations provided in the vicinity of the margins of the entry opening, e.g. in such a way as to prevent deflection of the wing portions towards each other. Such formations may be constituted by configuring the margins appropriately, e.g. by configuring them so that they are in-turned. Additionally or alternatively, the or each formation may be in the form of a lip, nib or the like provided on the end fitting at a suitable location in relation to the entry opening. the margins of the entry opening in such a way as to prevent deflection of the wing portions towards each other.

h. the margins are provided with lips, nibs or other blocking formations within the interior of the female part.

i. the end fitting includes a channel-defining portion at its forward end for reception of the forward end of the panel(s).

j. the male and female parts interfit in such a way as to permit the end fitting to tilt at least about an axis generally parallel to the longitudinal axis of the eaves structure.

k. the male part is provided on the end fitting while the female part is provided on the eaves structure or vice versa.

l. the end fitting is of a plastics material, metal or metal alloy (e.g. aluminium) and may be extruded.

m. the male and female parts are of generally part-circular configuration.

n. the arrangement is such that the male part forms a knuckle fitting within the female part which may be a socket associated with the eaves structure.

o. the male part has an arrowhead configuration.

p. the part associated with the eaves structure is located on the top wall thereof or at the junction between the top and the front wall of the eaves structure.

q. the part associated with the eaves structure is located on the front wall thereof.

r. the end fitting and eaves structure being coupled at one location by a fulcrum arrangement so that the end fitting can be mounted in different tilted attitudes with respect to the eaves structure.

s. the end fitting being adapted to be coupled to the eaves structure internally of the outer face of the latter and at a location spaced from the fulcrum arrangement.

t. the end fitting may include a channel-defining portion at its forward end for reception of the forward end of the panel(s) and a section which extends rearwardly between the panel(s) and the eaves structure and is adapted to be engaged with the eaves structure on the inboard side of the latter.

u. the end fitting comprising a channel for location at the eaves structure of the roofing structure and arranged to receive the forward end of a roofing panel, a laterally projecting leg which serves as a fulcrum to allow tilting or rocking of the end fitting relative to the eaves structure so as to accommodate the pitch of the roof, and a section extending rearwardly of the leg to provide a limb which extends laterally in the same general direction as the leg whereby the end fitting may be engaged with the eaves structure at a location on the inboard side of the eaves structure.

v. the fitting being provided with one or more projections for co-operation with the eaves structure to allow the extent of the tilting angle to be set.

w. the fitting being provided with a formation for interfitting with a generally complementary formation associated with the eaves structure.

x. the interfitting formations are of part-circular configuration and the arrangement is such that the formation associated with the fitting forms a knuckle fitting within a socket associated with the eaves structure.

y. the formation associated with the fitting is resiliently deformable to allow it to be deformed for insertion into the formation associated with the eaves structure.

z. a weatherproofing member for co-operation with the eaves beam.

The end fitting is to be understood to constitute an invention in its own right and the applicant reserves the right to seek protection for the end fitting independently of the glazing bar features which prevent lifting of the panels. Usually the other end of the roofing panel or panels extend to a ridge structure part of which overlies that end of the roofing panel(s) and it will be seen that the end fittings in accordance with the above aspects of present invention will afford security against break-in even if the glazing bars are designed as disclosed in British Patent Application No. 2347963 because both ends of the panel remain trapped at the ridge and eaves structures thereby obstructing any attempt to remove the panel(s).

In terms of the end fitting, the invention may reside in a roofing structure comprising an eaves structure, glazing bars supported on the eaves structure, one or more roofing panels supported by the glazing bars and an end fitting including a portion overlying one end of the roofing panel, the end fitting being connected to the eaves structure through male and female connector parts which are arranged to be coupled together by push insertion of the male part into the female part in a direction transverse to the eaves structure in such a way that the male part is captive against withdrawal in the opposite direction to insertion.

In a modification, the aspect of the invention relating to end fittings may reside in a roofing structure comprising an eaves structure, glazing bars supported on the eaves structure, one or more roofing panels supported by the glazing bars and an end fitting including a portion overlying one end of the roofing panel, the end fitting and eaves structure being coupled at one location by a fulcrum arrangement so that the end fitting can be mounted in different tilted attitudes with respect to the eaves structure and the end fitting being adapted to be coupled to the eaves structure internally of the outer face of the latter and at a location spaced from the fulcrum arrangement.

In another expression, this aspect of the invention may reside in an end fitting comprising a channel for location at the eaves structure of the roofing structure and arranged to receive the forward end of a roofing panel, a laterally projecting leg which serves as a fulcrum to allow tilting or rocking of the end fitting relative to the eaves structure so as to accommodate the pitch of the roof, and a section extending rearwardly of the leg to provide a limb which extends laterally in the same general direction as the leg whereby the end fitting may be engaged with the eaves structure at a location on the inboard side of the eaves structure.

Eaves Beam and Cill/Framework Features

Another aspect of the present invention relates to the construction of conservatories of the type in which glazed window frames are provided between an eaves beam and a cill, the eaves beam and the cill being in the form of extruded profiles, e.g. of a metal such as aluminium or aluminium alloy or of a plastics material.

One of the problems associated with the fabrication of such conservatories lies in the cutting of the extruded profiles to form corner joints. This is generally done by mitring of adjacent sections of the extruded profile. To ensure accuracy, the cutting is often done off-site (e.g at factory premises) and the previously mitred profiles are then transported to the erection site.

This aspect of e present invention seeks to provide a conservatory design which eliminates the need for the production of mitred joints between sections of the eaves beam and/or cill profiles.

This aspect of the invention consists in a conservatory framework comprising an eaves structure from which the roof is supported and a cill for mounting one or more window frames located below the eaves structure, at least one corner and/or in-line joint in the eaves structure being formed by a separate connector which interconnects adjacent sections of the eaves structure and comprises a block having side faces from which projections extend for reception within the profile of the eaves structure.

This aspect of the invention also consists in a conservatory framework comprising an eaves structure from which the roof is supported and a cill for mounting one or more window frames located below the eaves structure, at least one corner and/or in-line joint in the eaves structure and the cill being formed by a separate connector which interconnects adjacent sections of the eaves structure and/or the cill, the eaves connector comprising a block having side faces from which projections extend for reception within the profile of the eaves structure.

In this way, the need to mitre the profiled sections is eliminated. Instead, each profiled section may be cut substantially at right angles relative to the length of the section and the connector may be configured to interconnect the profile sections at a predetermined angle relative to each other.

The connector may be arranged to interfit with each profiled section in such a way that the two components are telescopically interconnected, e.g. so that one component inserts into the other. For example, the connector may have two angularly related projections each for receiving or reception in an end of one of the profiled sections.

A framework in accordance with this aspect invention may have any one or more of the following features:

a. a load-transmitting member extends between at least one eaves structure connector and a cill connector disposed below.
b. a plurality of such load-transmitting members is provided and the weight of the roof is transmitted by such members so that the window frames in use are largely relieved from carrying the weight of the roof.
c. the connectors are adapted to locate the load-transmitting members.
d. the upper ends of the load-transmitting members are engaged in recesses in the eaves structure connectors.
e. the lower ends of the load-transmitting members are registered with apertures in the cill connectors.
f. at least one connector is a corner connector.
g. at least one connector is a corner connector defining a right angled corner.
h. at least one connector is a corner connector defining an angle greater than 90°.
i. at least one connector is an in-line connector.
j. each connector and the adjacent section interengage with each other with one component received at least in part within the other.
k. said side faces are angularly related to one another so that adjacent eaves sections are interconnected at an angle to one another.
l. the eaves structure and/or the cill is formed by an extruded profile.
m. the connector is a cill connector and has a profile which generally corresponds to that of the adjacent cill sections.
n. the cill sections engage within the cill connectors.
o. the connectors are of plastics material.
p. the eaves structure connector is adapted to mount a glazing bar for tilting adjustment relative to the eaves structure.
q. the eaves structure connector is provided with a channel for tiltably receiving a component for coupling a glazing bar to the eaves structure.
r. the component comprises a bolt, the head of which is received tiltably within the channel.
s. the component comprises a mounting shoe for a glazing bar which may have any one or more of the features disclosed below.

Glazing Bar Shoe Features

This aspect of the invention is applicable for example to glazed roofs of the type comprising panels, e.g. of glass or a plastics material such as polycarbonate or polyvinyl chloride, supported between glazing bars which may be produced as extruded profiles. The glazing bars are coupled at one end to an eaves beam and extend upwardly to a fixing location at the opposite end, usually a ridge structure of the roof.

To allow for the pitch of the roof, it is known to connect the lower ends of the glazing bars to the eaves beams in such a way that they can be tilted to accommodate the desired roof pitch. In one known arrangement as disclosed in British Patent Application No. 2347963, the lower ends of the glazing bars are coupled to the eaves beam by a bolt having a head which is pivotally located in a channel forming part of the eaves beam.

This aspect of the present invention seeks to provide an improved means for coupling the glazing bars to an eaves beam which affords greater flexibility during on-site installation.

The glazing bar mounting shoe constitutes an invention in its own right and the applicant reserves the right to seek protection for the same both in combination with other features disclosed herein, including the eaves and cill features as disclosed above, and also independently of such other features. The shoe serves to intergage with and locate one end of a glazing bar, the shoe being adapted to be tiltably mounted on an eaves structure and the arrangement being such that the glazing bar is insertable endwise into the shoe, the shoe including an end stop which limits the extent to which the bar is insertable into the shoe. The shoe may have one or more of the following features in any combination admitted by the context:

a. the shoe and the bar slidably intergage one within the other.
b. the bar is received within the shoe.
c. the shoe and the bar interengage as a close fit (e.g. an interference fit) so that the shoe and bar may remain interengaged without the aid of a fastening means.
d. the glazing bar is insertable endwise into the shoe.
e. the shoe includes an end stop which limits the extent to which the bar is insertable into the shoe.
f. the shoe is of channel-section.
g. the shoe is of channel-section and in which the bar is insertable into the shoe through one end of the channel.

h. the glazing bar comprises an inner T-shaped member comprising a cross-piece and a central stem.

i. the inner member is insertable endwise into the channel-section shoe in such a way that the cross-piece is trapped within the channel and the stem of the T projects through an open mouth of the channel.

j. the cross-piece is trapped in the channel by a flange or flanges bounding the mouth of the channel.

k. the glazing bar comprises an inner member and an outer member attachable to the inner member and in which the shoe includes means for preventing separation of the outer member from the inner member at the lower end thereof when the glazing bar is engaged with the shoe in the normal position of use.

l. the separation-preventing means comprises an projection co-operating with the outer member when the glazing bar is engaged with the shoe.

m. means is provided for use in fastening the glazing bar to the shoe to prevent separation of the bar from the shoe.

n. such means is external to the channel.

o. the channel is provided with an end plate to limit insertion of the bar and in which bracing plates are provided for use in connection of the end plate to the channel.

p. the bracing plates form the means for use in fastening the bar to the shoe.

q. the shoe includes a projection for co-operation with a socket associated with the eaves structure or eaves structure connector to allow tilting of the shoe and hence a glazing bar coupled to the shoe.

r. the projection includes a portion having a curvilinear outer surface for co-operation with the socket.

s. the curvilinear portion of the projection is generally cup-shaped.

t. the projection includes a generally cylindrical or generally part-cylindrical portion for engagement within the socket.

In another expression of this aspect of the invention, the eaves structure connector may comprise a block for interposition between adjacent eaves beam sections and having means for interengagement with adjacent eaves beam sections, means for tiltably mounting a glazing bar and means for registry with a load-transmitting member for transferring the weight of a roof supported from the eaves structure to said member.

Such an eaves structure connector may be used in combination with a glazing bar-mounting shoe tiltably engageable with the connector.

Also, this aspect of the invention may reside in a corner, in-line or end connector for use with an eaves beam structure or a cill, the connector being adapted to interfit with a non-mitred end of an extruded eaves beam or cill profile (which may of closed or open configuration) so as extend beyond the end of the profile and provide means for location of load-transmitting components associated with the eaves beam and/or cill.

Such a connector may have two projections which are in-line or angularly related and serve to interconnect adjaent eaves beam or cill sections.

The connector may comprise an end connector having a single projection for coupling with the end of an eaves beam or cill profile.

In a framework as defined above, the eaves structure and/or cill may terminate in an end connector as defined in the preceding paragraph.

Coupling of Ridge Cap to Ridge Structure

This aspect of the invention relates to roof structures, especially for conservatories and is particularly concerned with the coupling of a ridge cap to a ridge structure.

In a known roof ridge structure for a glazed roof (see UK Patent No. 2284836), a ridge cap is secured to the ridge structure by rigid bolts which have heads engaging in a channel on the underside of the ridge cap and which pass through openings in the roof structure to allow the cap to be secured place by nuts.

This arrangement requires the ridge cap to be located in place at the apex of the ridge structure and the bolts registered with the cap and the ridge structure after the roofing panels have been put in place, making it necessary for the installer to get on to the roof to position the ridge cap accurately and register the bolts with the cap and with apertures in the ridge structure to allow the nuts to be connected to the bolts from a location below the ridge structure.

This aspect of the present invention seeks to provide a more flexible coupling of the ridge cap to the ridge structure which does not necessarily require the installer to get on to the roof in order to complete fitting of the ridge cap.

This aspect of the present invention resides in a ridge assembly for a roof comprises a ridge structure, a ridge cap for fitting atop the ridge structure, the ridge cap having a channel at its underside, and at least one fastener having an enlarged part for reception and retention in the channel, the fastener comprising a flexible tie by means of which the cap can be secured from beneath the ridge structure by a locking member co-operating with the tie.

The tie may have one or more of the following features in any combination where the context admits:

a. the enlarged portion of the fastener is insertable as a push fit through the mouth of the the channel in such a way that the enlarged portion is held captive against withdrawal through the channel mouth.

b. lateral projections may be provided which are resiliently deflectable to allow the enlarged head to contract as it is pushed into the channel.

c. the enlarged portion is of arrowhead configuration.

d. the enlarged portion is designed so that in one orientation it passes substantially freely through the channel mouth but when turned to a second orientation it is rendered captive against withdrawal through channel mouth.

e. the tie is provided with a series of formations along its length which coact with the locking member in ratchet fashion as the locking member is displaced in one direction along the tie, the ratchet arrangement preventing reversal of such displacement.

f. the locking member includes a release member to disable the ratchet action and allow reverse displacement of the locking member.

g. the locking member is arranged so that in one orientation relative to the tie it co-operates with the ratchet formations but in a second orientation it is clear of the ratchet formations and is free to be displaced along the tie away from the enlarged portion.

h. the tie is produced in a length somewhat longer than needed for securing it in place. This allows the ties to be coupled to the ridge cap and then passed through apertures in the ridge structure during construction of the roof so that the ends of the tie are accessible from beneath the ridge structure before the cap is located in its final position.

The various aspects of the invention will now be described by way of example only with reference to the accompanying drawings, in which:

Hipped Roof Features

Security Features of Roof Structure

Figure 1:
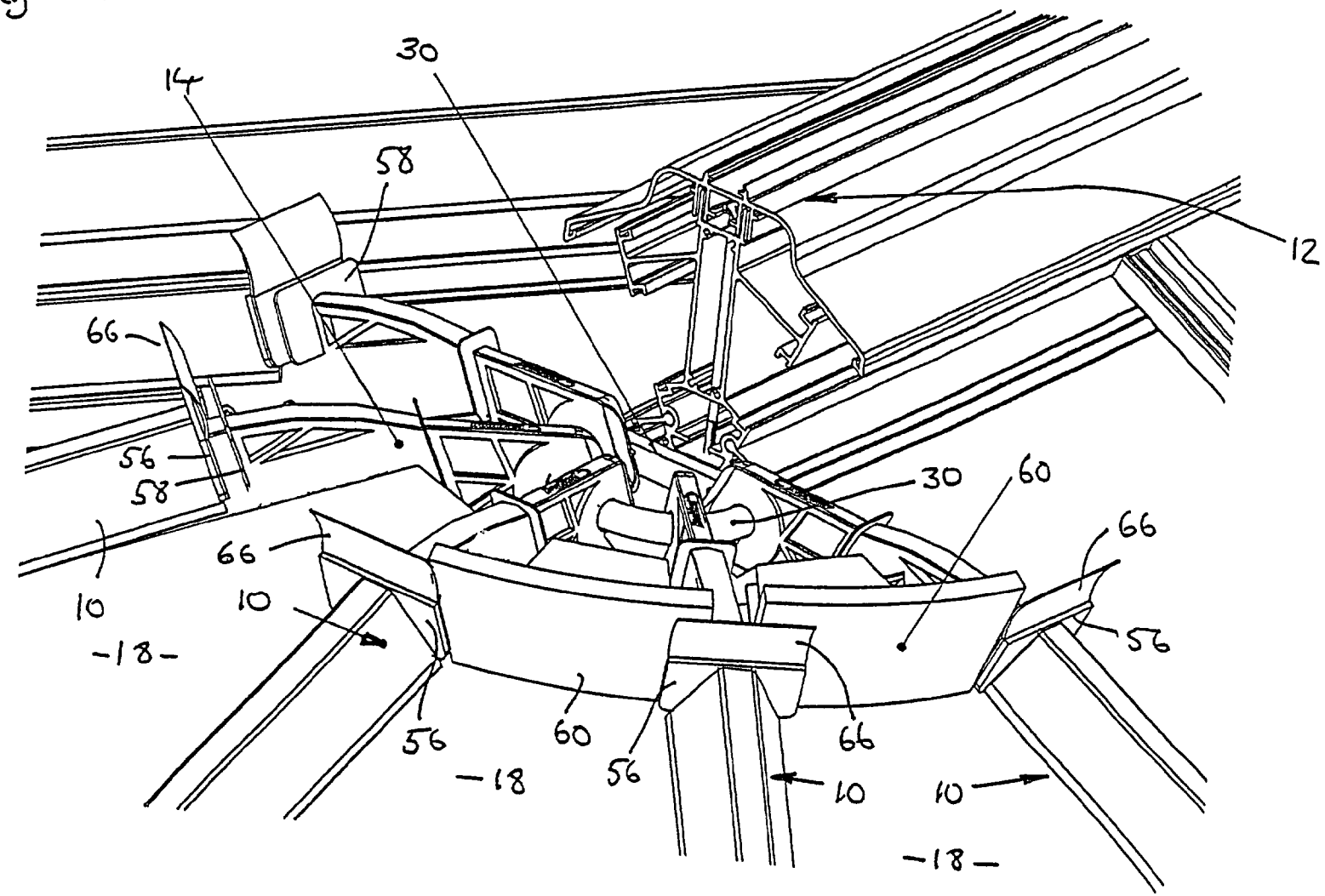
FIG. 1 is a perspective view of one end of a conservatory roof showing a number of panel-supporting bars radiating from the ridge end.
Figure 1A:
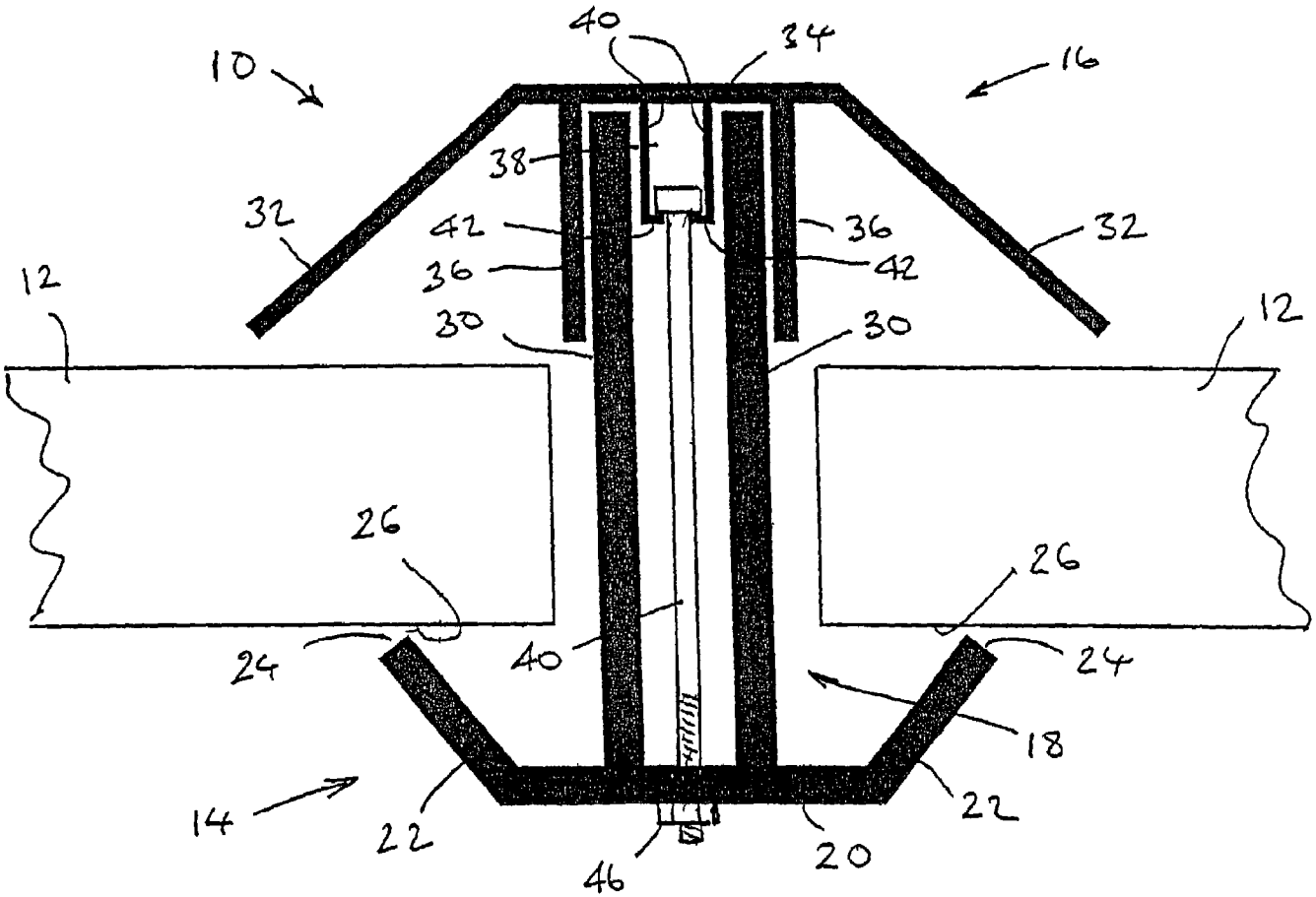
Figure 2B:
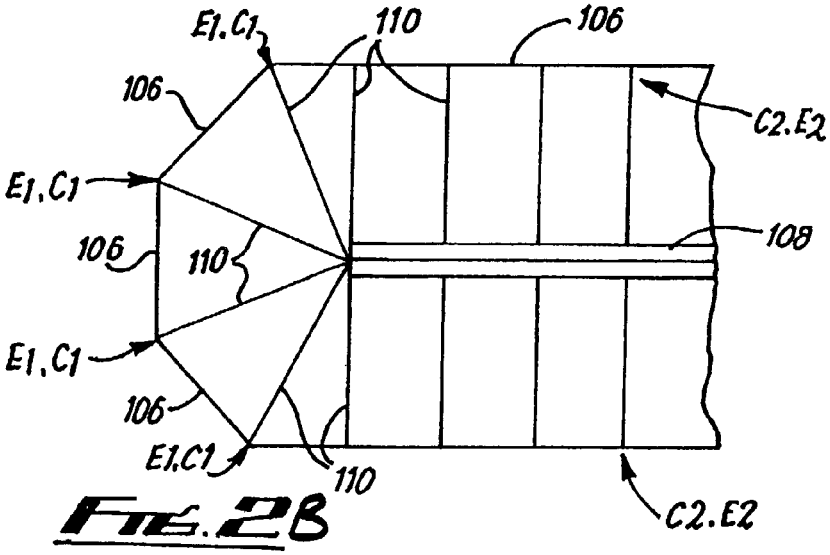
FIG. 2 is a side view showing coupling of one supporting bar to the ridge structure, with the ridge structure and supporting bar sections also illustrated.
Figure 3B:
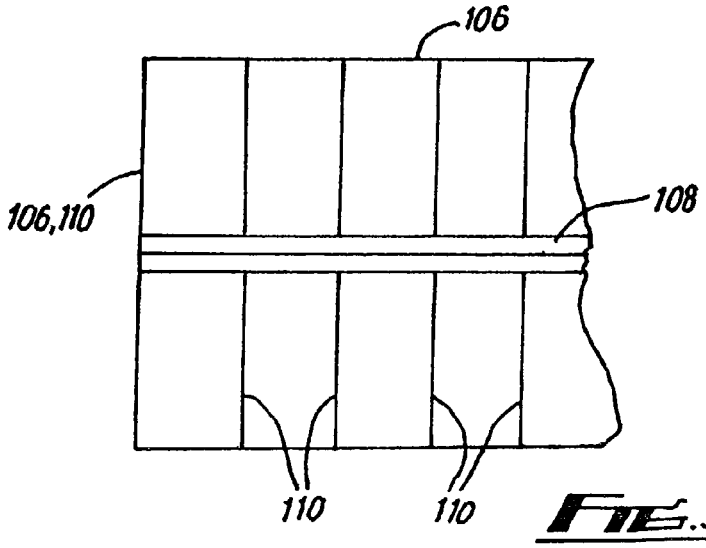
FIG. 3 is an exploded perspective view of a bar and connector.
Figure 2:
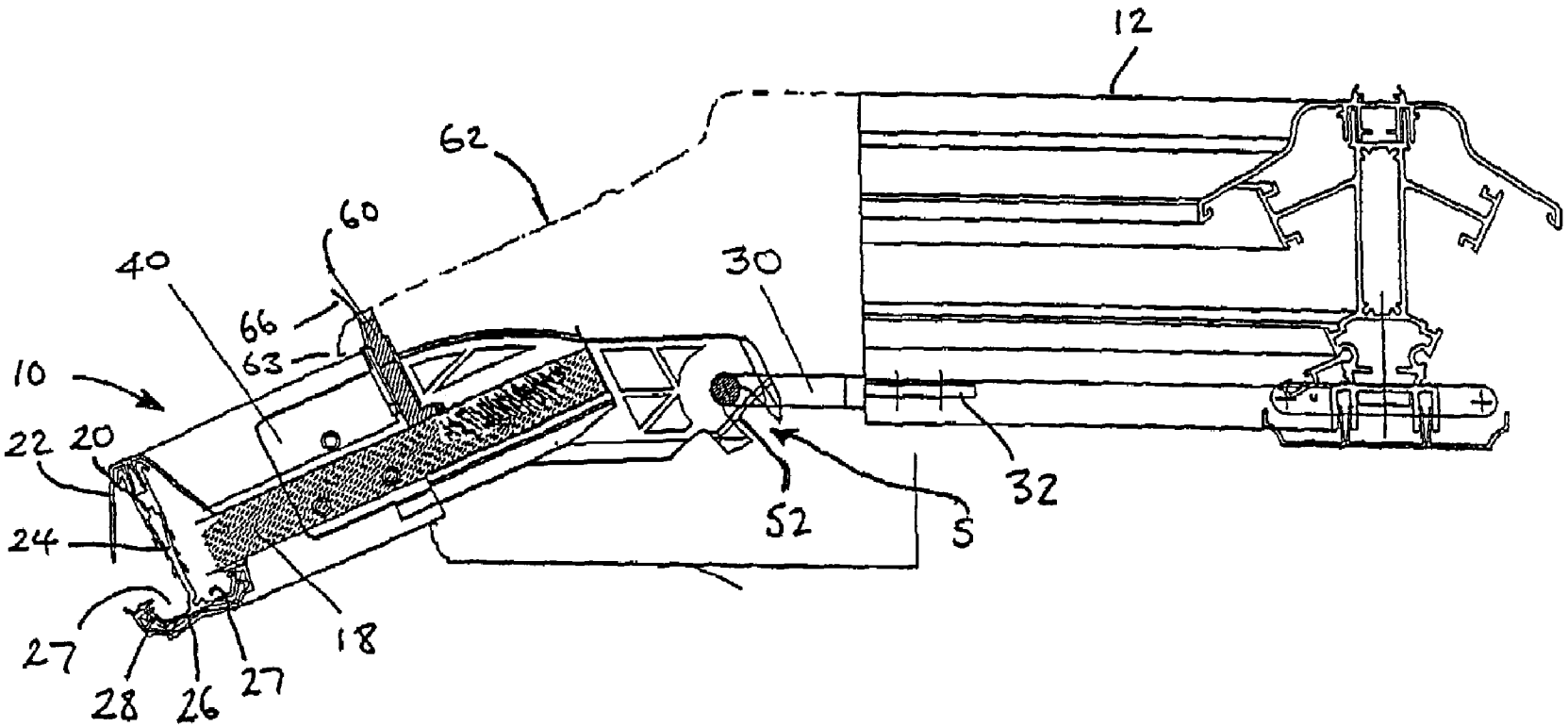
Figure 2A:
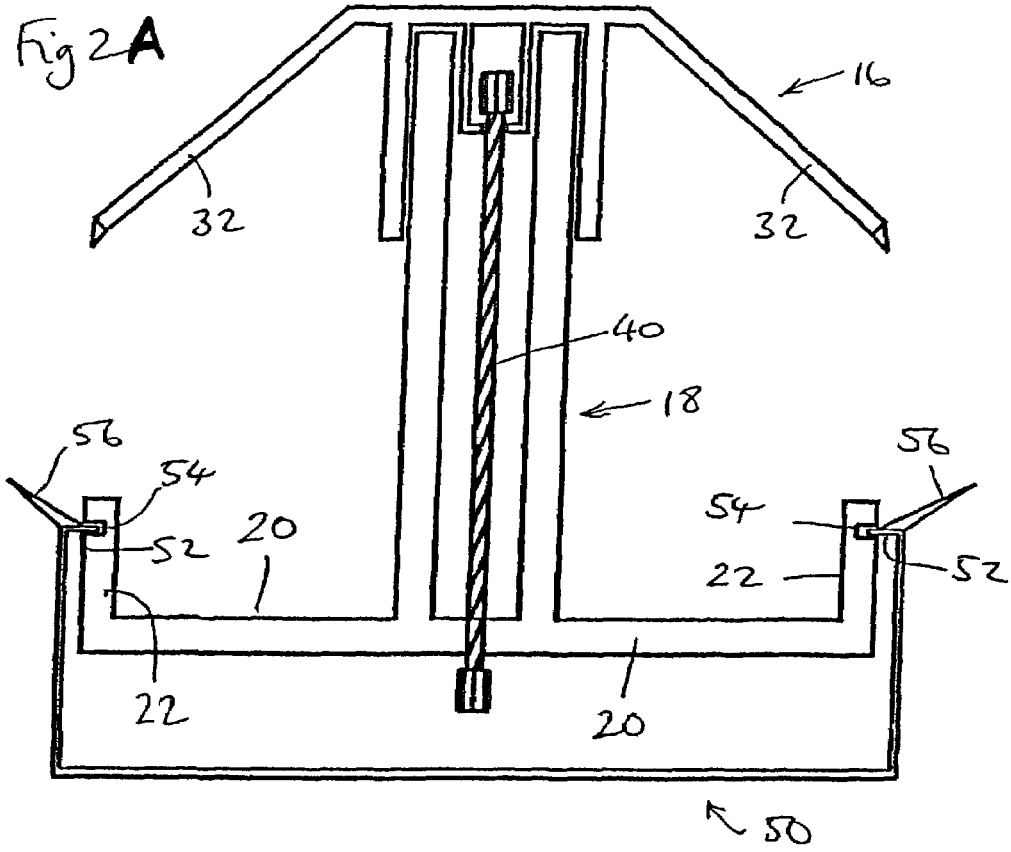
Figure 3A:
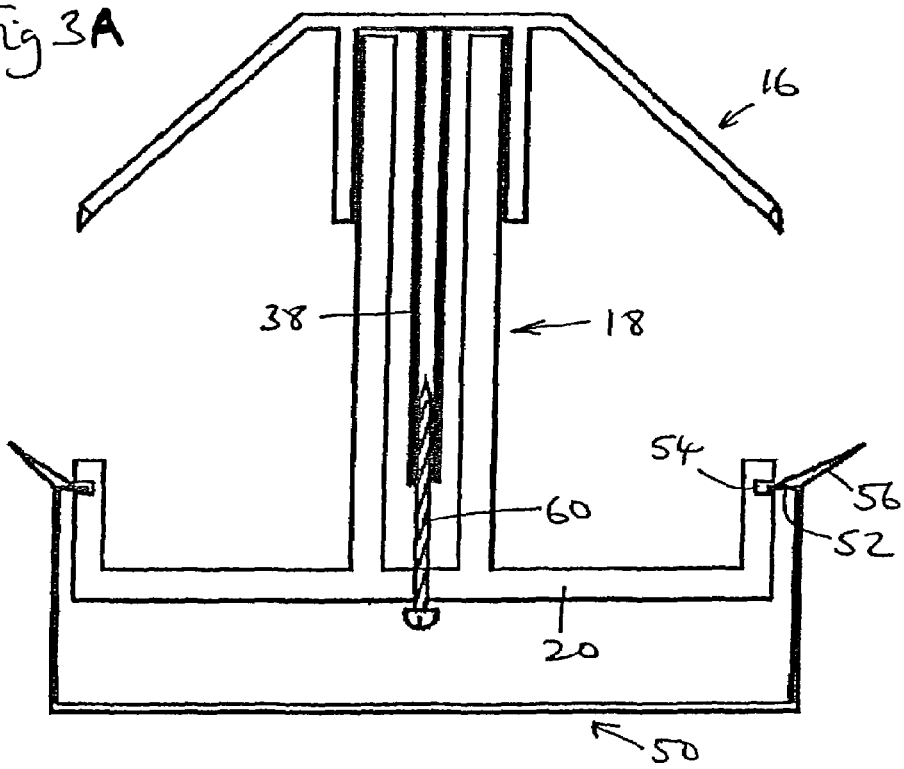
Figure 9B:
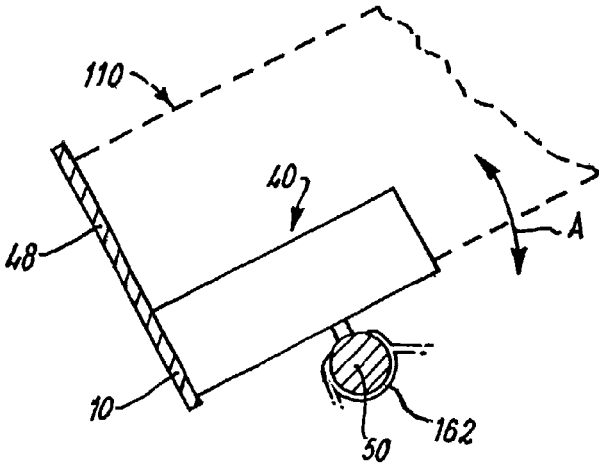
Figure 10B:
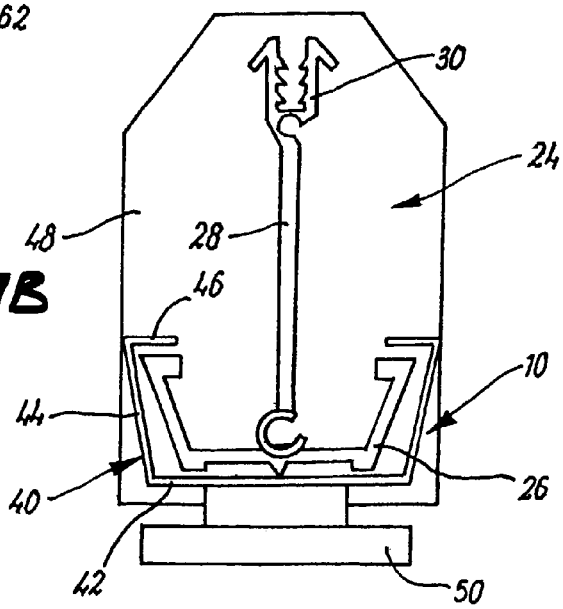
Figure 9A:
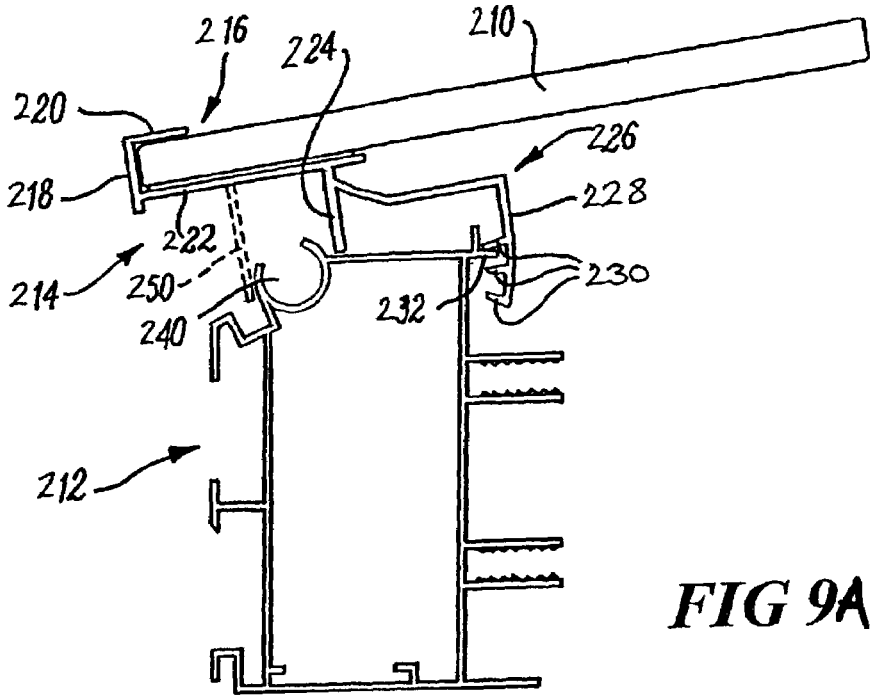
Figure 10A:
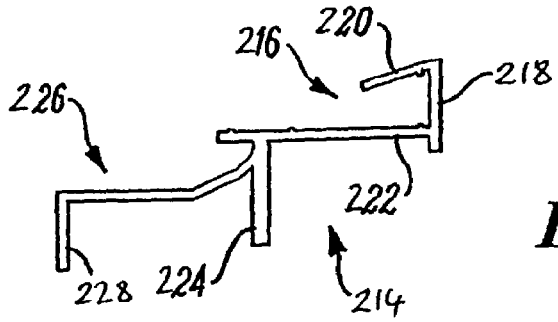
Figure 11A:
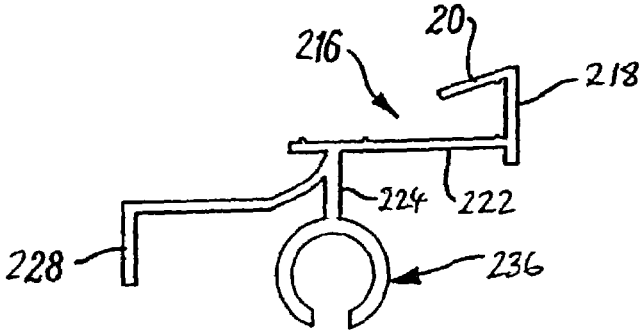

FIG. 1A is a cross-sectional view of one embodiment of a glazing bar assembly in accordance with the present invention shown in conjunction with two glazing panels, the glazing bar assembly being arranged to trap the side edges of the panels in such a way as to hinder an intruder attempting to break in by removing the roofing panels;

FIGS. 2A and 3A are similar views to that of FIG. 1A but showing modifications thereof;

FIGS. 4A to 8A each show a cross-sectional view through additional embodiments of a glazing bar in accordance with the present invention;

FIG. 9A is a sectional view through the eaves structure of a pitched conservatory roof, illustrating one form of end fitting;

FIG. 10A is a cross-sectional view illustrating a second form of end fitting;

FIG. 11A is a cross-sectional view illustrating a third form of end fitting.

Figure 12B:
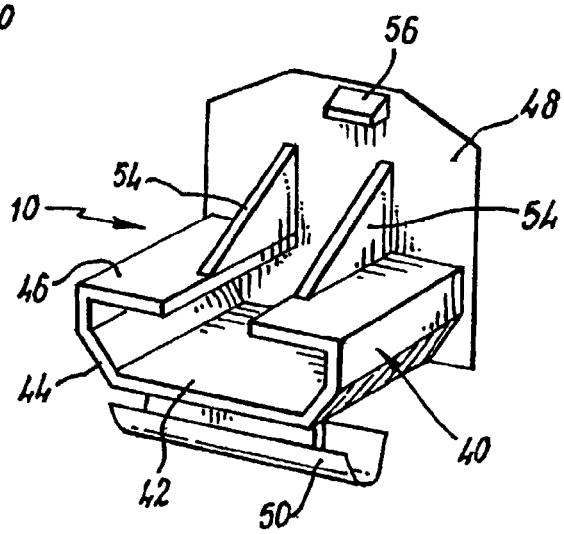
Figure 13B:
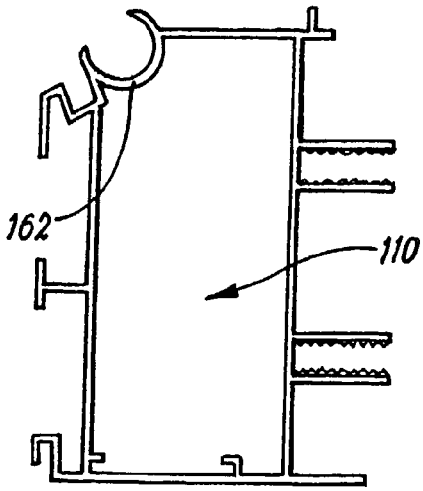
Figure 12A:
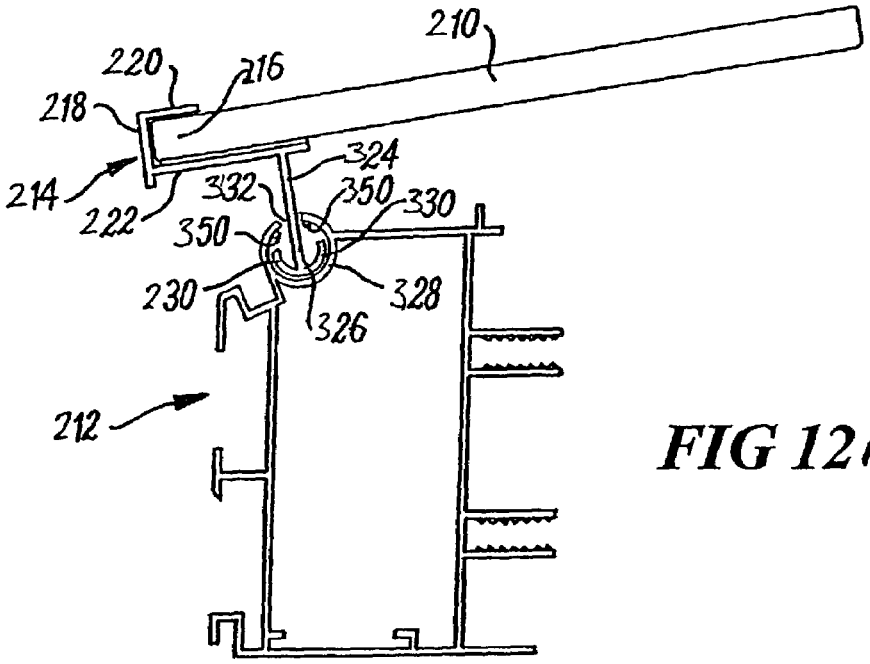
Figure 13A:
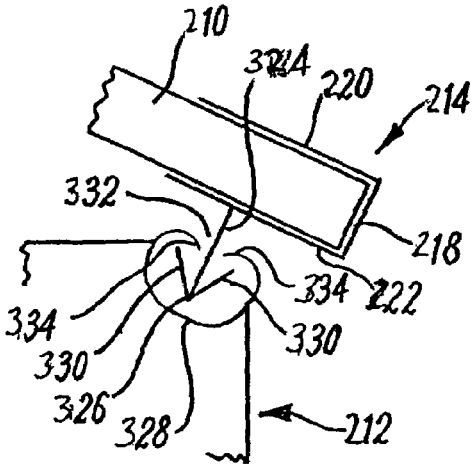
Figure 14A:
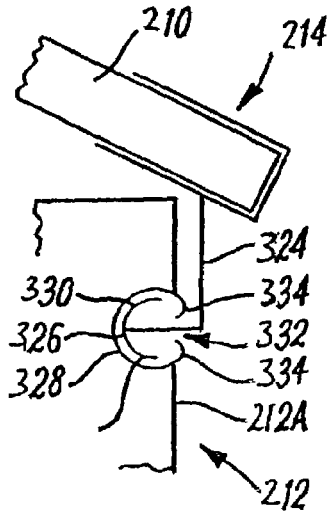

FIG. 12A is a similar view to that of FIG. 10A, illustrating another form of end fitting;

FIG. 13A is a sectional view illustrating a further form of end fitting; and FIG. 14A is a sectional view illustrating yet another form of end fitting.

Eaves Beam and Cill/Framework and Glazing Bar Shoe Features

Figure 1B:
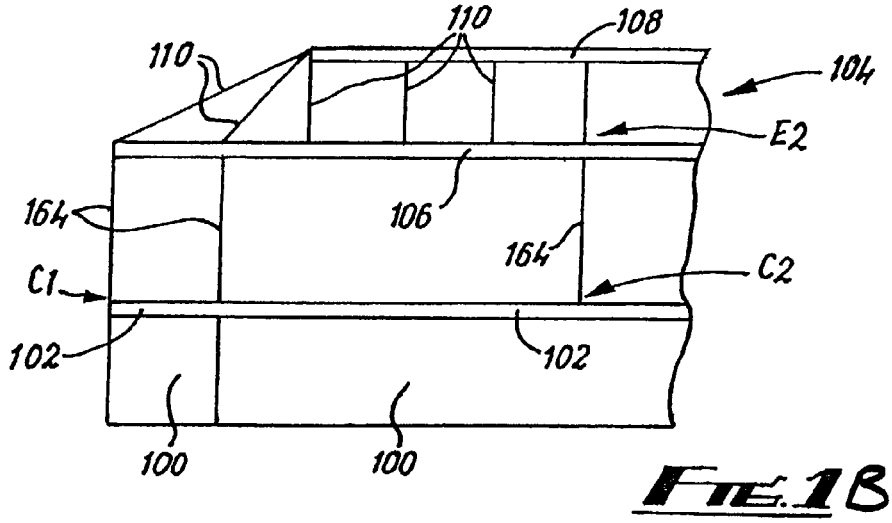
Figure 4A:
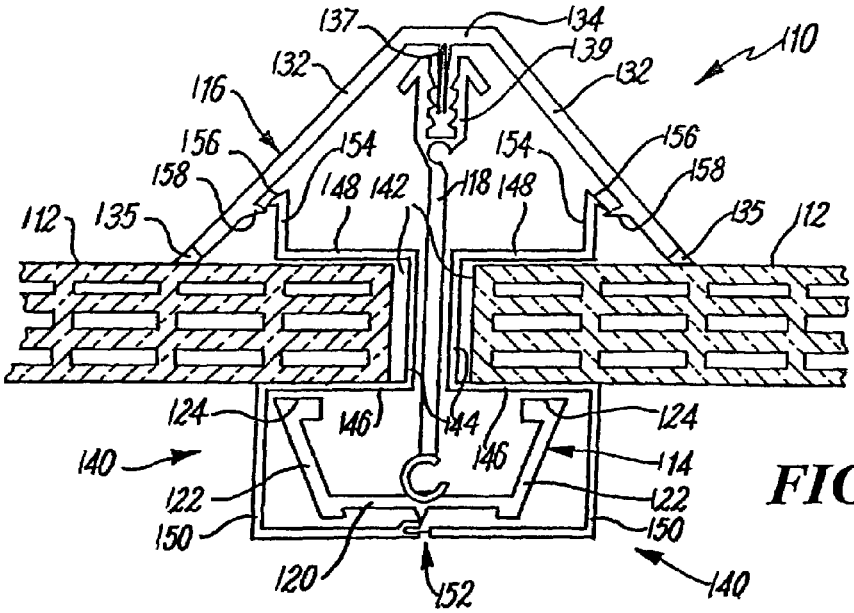
Figure 5A:
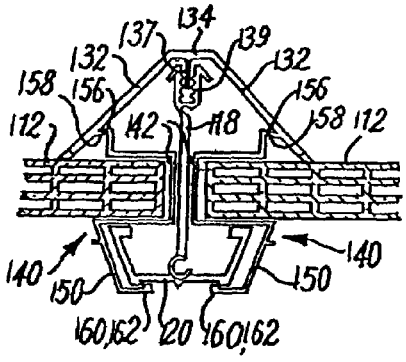
Figure 6A:
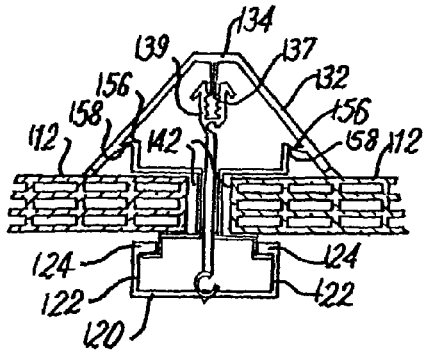
Figure 7A:
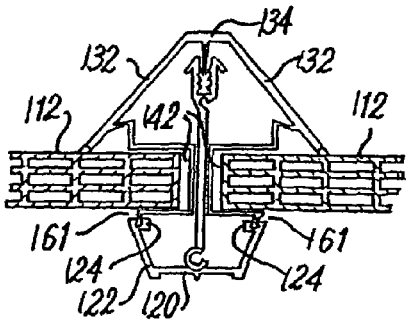
Figure 8A:
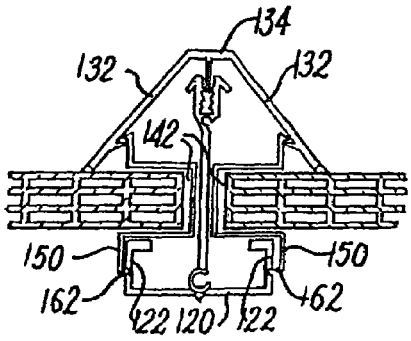
Figure 4B:
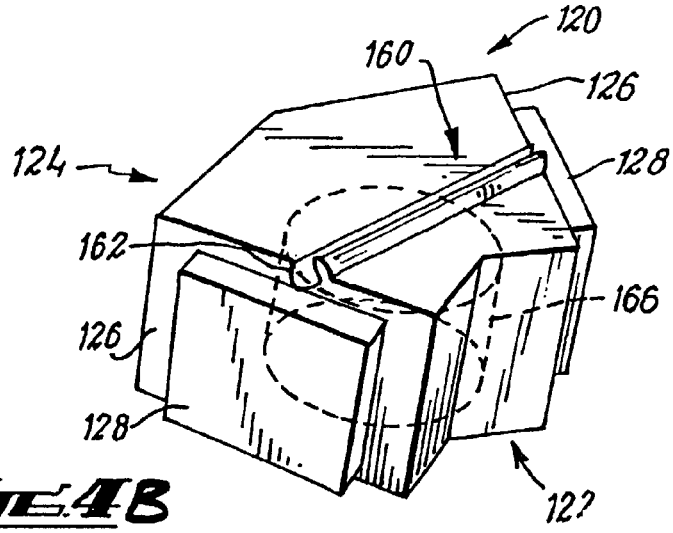
Figure 5B:
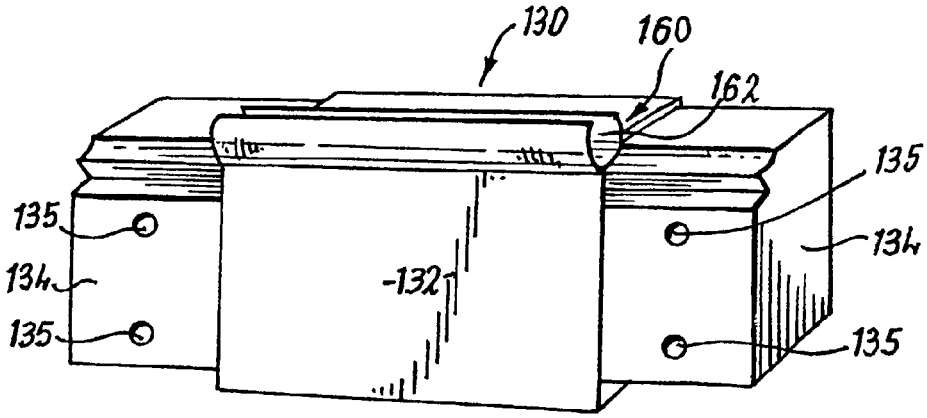
Figure 6B:
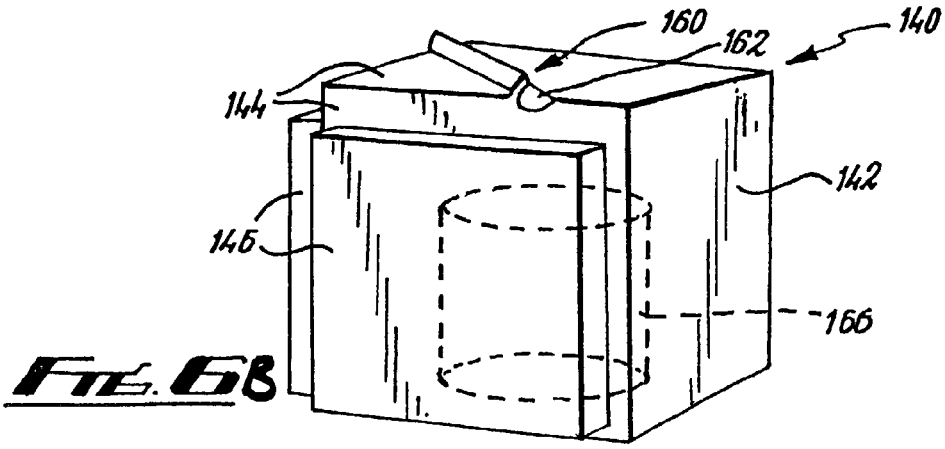
Figure 7B:
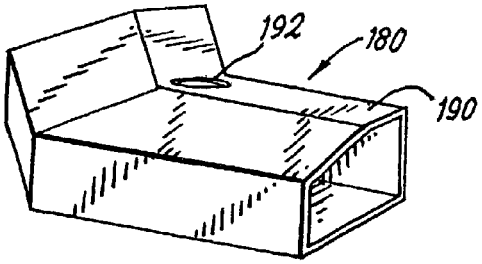
Figure 8B:
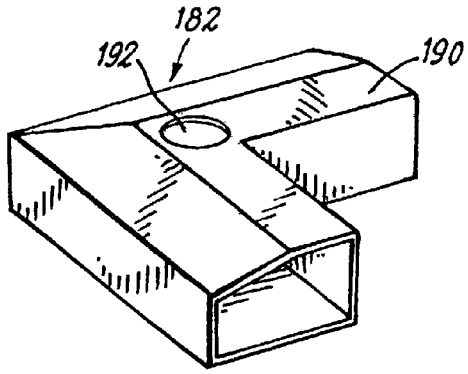
Figure 11B:
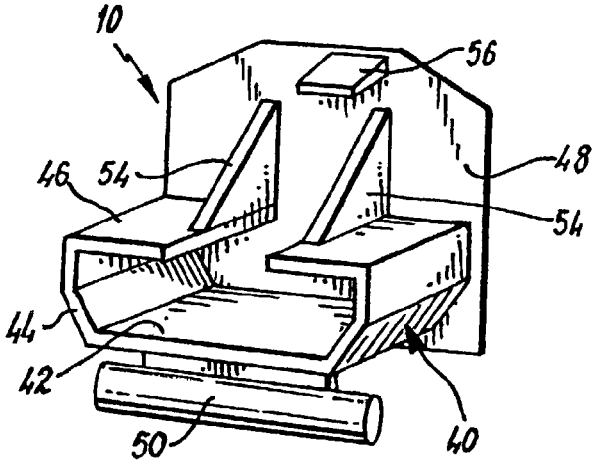

FIG. 1B is a diagrammatic line drawing showing part of a conservatory framework from a side elevation;

FIG. 2B is a corresponding plan view of the conservatory framework;

FIG. 3B is a diagrammatic plan view of the roof structure of an alternative design;

FIG. 4B is a perspective view of one form of connector block for use in making joints at corner of the eaves beam structure of the form shown in FIGS. 1B and 2B;

FIG. 5B is a perspective view of one form of connector block for use in making in-line joints in the eaves beam structure;

FIG. 6B is a perspective view of a connector block for use in making joints at corner of the eaves beam structure shown in FIG. 3B;

FIGS. 7B and 8B perspective views of cill corner connectors for use at the corners of the conservatory frameworks shown in FIGS. 1B and 3B respectively;

FIG. 9B is a diagrammatic side elevation showing a glazing bar mounting shoe for assembly to a corner or in-line eaves beam connector of the present invention or directly to the eaves beams themselves;

FIG. 10B is a diagrammatic end view of the shoe of FIG. 9, also showing the profile of the inner member of the glazing bar;

FIGS. 11B and 12B are diagrammatic perspective views of alternative forms of shoe;

FIG. 13B is a cross-sectional view of an eaves beam extruded profile; and

Figure 14B:
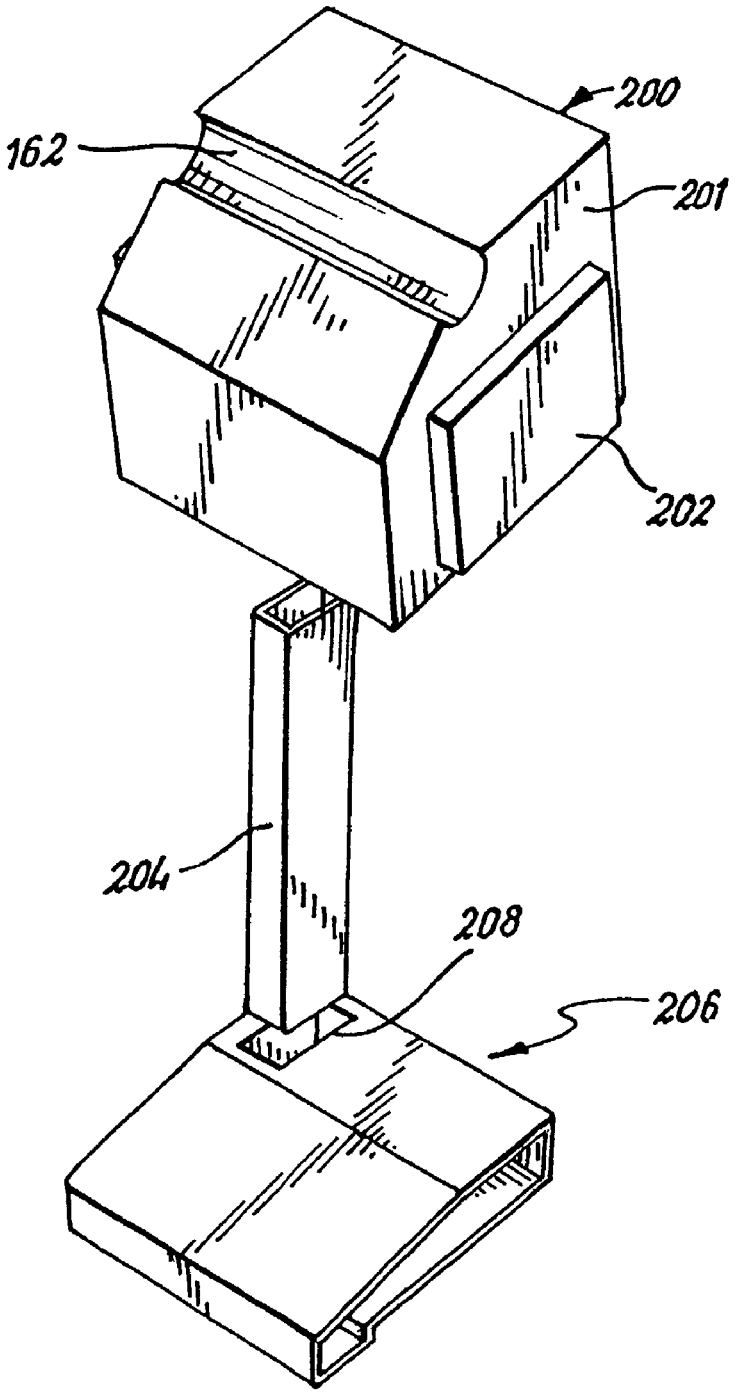

FIG. 14B is a diagrammatic perspective view of an assembly comprising an eaves beam end connector, a cill end connector and a load-transmitting post.

Coupling of Ridge Cap to Ridge Structure

Figure 2C:
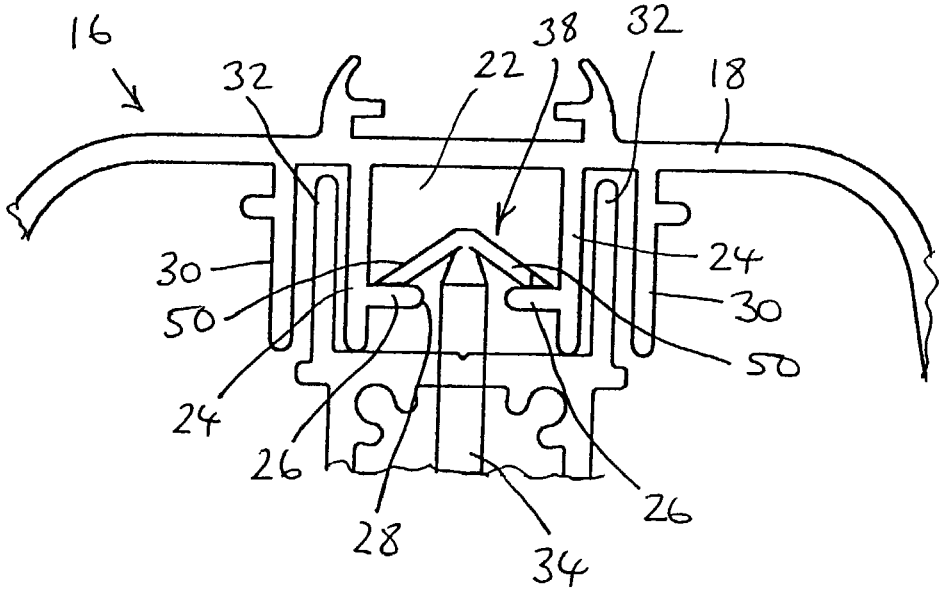
Figure 3C:
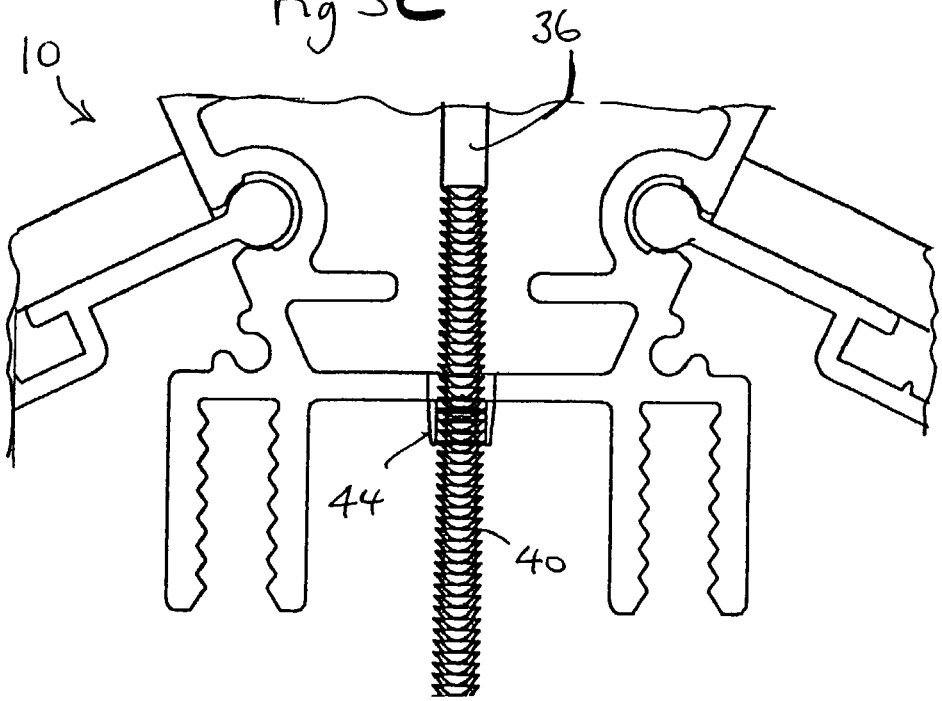

FIG. 1C is a cross-sectional view of the ridge of a roof incorporating one embodiment of a ridge assembly in accordance with the present invention;

FIG. 2C is a fragmentary enlarged view of the upper part of the view shown in FIG. 1C;

FIG. 3C is a fragmentary enlarged view of the lower part of the view shown in FIG. 1C;

FIG. 4C is a perspective view of the tie for securing the cap to the ridge structure;

FIGS. 5Ca–5Cf are different views of a locking member for use with the tie.

Hipped Roof Features

Figure 3:
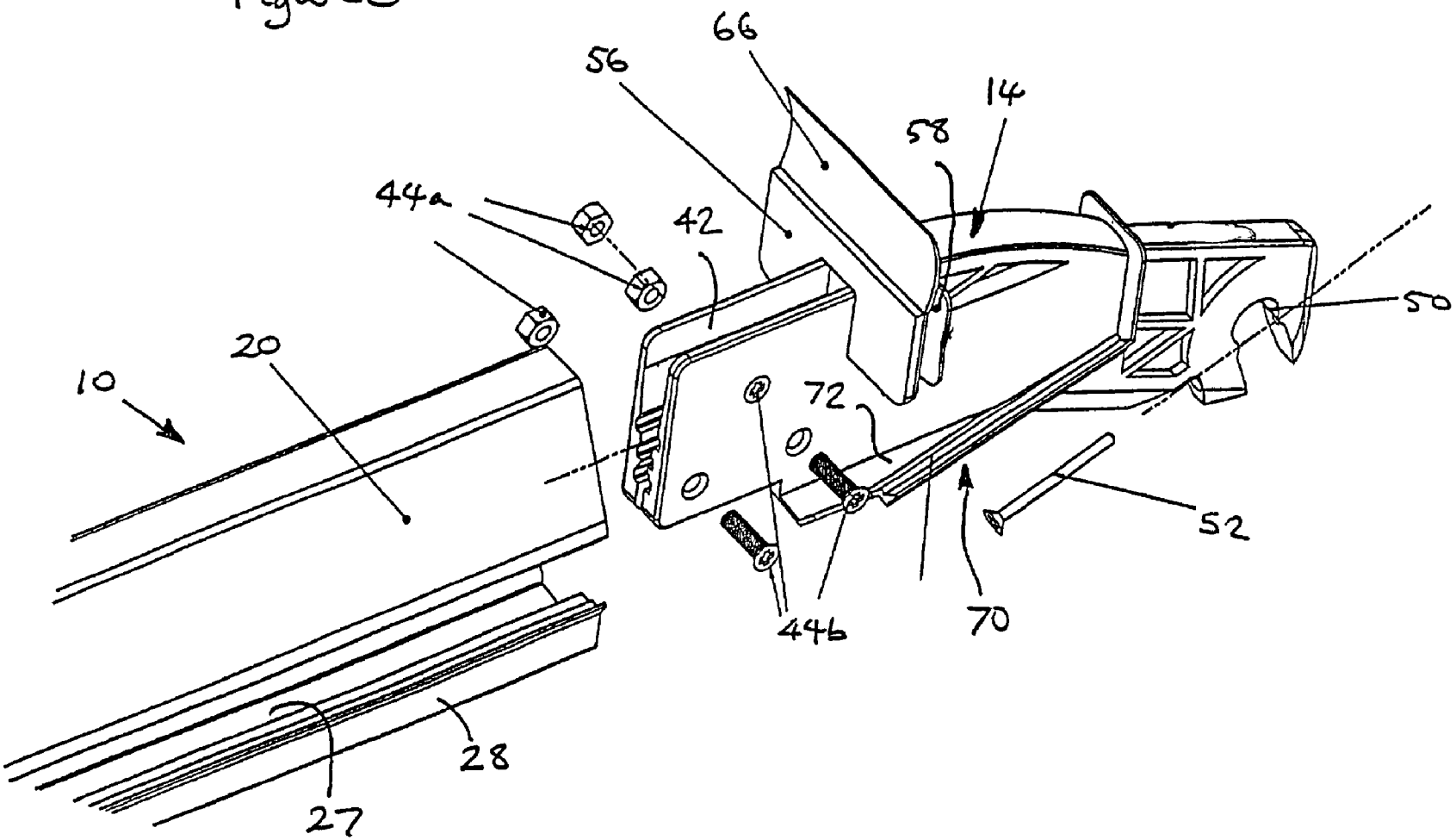

Referring to the FIGS. 1 to 3 of the drawings, the hipped roof section of a conservatory roof comprises a number of elongated, panel-supporting bars 10 which are linked to the ridge structure 12 by means of connectors 14 which engage with a mounting element 16 of arcuate configuration located at the end of the ridge structure. The ridge structure 12 and the supporting bars 10 are typically produced as extrusions with the cross-sections illustrated in FIG. 2.

The bars 10 extend between the ridge structure 12 and an eaves beam (not shown) and roofing panels 18 (see FIG. 2) are supported between adjacent pairs of bars. The roofing panels are typically in the form of polycarbonate, polyvinyl chloride or glass, each panel being supported at its edges by the bars 10.

Each bar 10 comprises an inner member 20 and an outer member 22 either of both of which may be manufactured as aluminium extrusions. The panels 18, in use, are trapped between the inner and outer members 20, 22 and extend from the eaves beam to a point proximate the ridge end. The inner member 20 is generally T-shaped comprising a central portion 24 and a cross-piece 26 which has upwardly directed flanges 28 forming shoulders on which the inner faces at the panel edges of the panels 18 can seat. The construction and design of the bars 10 may be as described in detail in other embodiments disclosed herein. For present purposes, a notable feature of the inner member 20 is the provision of channels 27 formed by the cross-piece 26 and flanges 28, which channels serve as drainage channels in circumstances where ingress of water might occur despite the use of seals associated with the inner and outer members 20, 22.

The mounting element 16 in the illustrated embodiment is in the form of a generally semi-circular ring 30 (a D-shaped ring) which is secured to the ridge structure 12 by plate 32. Each bar 10 is linked to the D-ring 30 by the connectors 14, one of which is illustrated in detail in FIGS. 2 and 3. Each connector 14 may be produced as a plastics moulding from a suitably robust material for the purpose and comprises a first rearward section 40 which is insertable into the two-part bar 10 in such a way that the central portion 24 of the bar enters a central channel 42 of the section 40, the section 40 being apertured so that the connector can be fastened securely , e.g. by nuts and bolts 44*a, b,* to the central portion 24 in such a way that the connector 14 then forms a continuation of the bar 10. This arrangement allows the bars 10 to be square cut, thereby simplifying fabrication.

The connector further includes an intermediate section 46 and a forward section 48 which is angularly related to the rearward section 40 and terminates in a downwardly directed hook-like formation 50 for engagement with the D-ring 30 in the manner illustrated in FIG. 1. To ensure that the formation 50 is securely anchored to the D-ring, its open end may be bridged by a screw or other fastener 52 to eliminate any risk of the formation becoming accidentally disengaged from the D-ring 30. If desired, the arrangement may be such that the fastener 52, when tightened, causes the sides of the formation 50 to deform so as to grip the D-ring.

The intermediate section 42 is provided with location means comprising spaced flanges 56, 58 projecting laterally of each side face of the connector and also upwardly relative to the top of the connector. When the connector section 40 is fully inserted into the bar 10, the end of the bar abuts against the flange 56. The flanges 56, 58 define channels on each side of the connector for the location of strips 60 of sealing material, e.g. a resilient foam material so that the strips can seat on the panels 18 and at least substantially bridge the gap between the upper faces of the panels 18 and the underside of an overlying, external cap 62 (shown in broken outline in FIG. 2) associated with the ridge structure 12. It will be seen that the channels formed by spaced flanges 56, 58 locate and retain the end edges of the strips 60 which may be square cut as illustrated or, alternatively, may be shaped so as to extend across the connectors.

The lower edge of the strips 60 are intended to make sealing contact with the panels. If desired, the seal may be enhanced by the application of a mastic or other sealing material which can be applied as a bead along the junction between the strips 60 and the roof panels. The upper edges of the strips 60 may also make sealing contact with the underside of the cap 62 although this is not essential as a small gap may be tolerated athtis point because the main source of rainwater ingress will tend to be by way of water driven up the panels faces by the wind and this will be intercepted at the junction between the strips and the panels.

To avoid having to specially shape the end edges of strips 60 and thereby simplify fabrication, the flanges 56 may be overmoulded with a flexible gasket 66, the upper edge of which is designed to contact against the underside of the cap 62 and deform downwardly when the cap is located in place to provide sealing at that location. In this way, the relatively small gaps above the connectors 14 are effectively sealed by the gaskets 66. The downward deflection of the gaskets 66 may be in the forward direction, ie. towards the edge 63 of the cap 62.

It will be noted that the strips 60 are located at the forward opening of the gap between the panels and the cap 62 thereby intercepting As well as serving to connect the bars 10 to the ridge structure 12 and also locate the sealing strips 60, the connectors 14 additionally provide a drainage facility if and when needed. To this end, each connector is provided on each side with a lateral wing-shaped extension 70 on which the roofing panel edges seat in the proximity of the ridge end. The extensions form channels 72 which, when the connector is fitted to a supporting bar 10 merge, and desirably overlap to some extent, with the channels 27 associated with the cross-piece 26 of the inner member 20. The extensions 70 are formed with overmoulded gaskets 72 for sealing contact with the underside of the panels 18. Any water that might penetrate through the gap between the roofing panels 18 and the connectors 14 is collected by the channels 72 and, by gravity, is directed into the channels 27 and along the length of the bars to drainage points at the lower ends of the bars.

The flanges 56, 58 and/or the extensions 70 may be integrally formed with the connectors 14. Alternatively, these components may be formed separately from the connector as part of a component or components adapted to fitted to the connector.

Security Features of Roof Structure

FIGS. 1A to 14A illustrate embodiments of the present invention involving the provision of security means for preventing lifting of the roofing panels of for instance a conservatory by trapping both the side edges and/or the lower ends of the panels in a manner which severely hinders any attempt by a would-be intruder to effect break-in by lifting the roofing panels. Even if the would-be intruder succeeds in disabling the means trapping the side edges of a panel, the means trapping the lower ends of the panel also have to be contended with (or vice versa).

Referring to FIG. 1A, the glazing bars 10 according to the illustrated embodiment of the security aspect of the present invention are typically used in the construction of a glazed conservatory roof with each glazing bar extending between a ridge structure and an eaves beam. Glazing roofing panels 12 are supported by the glazing bar and are typically in the form of polycarbonate, polyvinyl chloride or glass, each panel being supported at its edges by the glazing bars.

Each glazing bar 10 comprises an inner member 14 and an outer member 16 either of both of which may be manufactured as aluminium extrusions. As used herein, "inner" and "outer" refer to the location of the components relative to the roofing structure. The inner member 14 is generally T-shaped comprising a central portion 18 and a cross-piece 20 which has upwardly directed flanges 22 forming shoulders 24 on which the inner faces at the panel edges 26 of the panels 12 can seat. The panels 12 may seat directly on the shoulders 24 or indirectly via interposed seals (not shown). The central portion 18 comprises a deep channel formed by two upstanding spaced apart walls 30.

The cross-piece 20 may in use be concealed on the internal side of the glazing bar in known fashion by a cladding section or sections of plastics material, aluminium or wood for example, the cladding section(s) being attachable to the inner member. The cladding section(s) may be provided with the seals on which the panels seat. FIG. 2A illustrates one form of cladding comprising a channel-section 50 having lips 52 which snap fit into grooves 54 formed in the flanges 22. The profile of the section 50 is generally the same as the cross-piece 20. In this embodiment, the flanges are shown as extending generally vertically but they need not necessarily do so. The cladding section 50 is also provided with seals 56 (e.g. co-extruded seals) for making sealing contact with the inner surfaces of the roofing panels.

The outer member 16 is generally V-shaped having downwardly directed legs 32 which extend from each side of a central section 34. The legs 32 together with the flanges 22 form openings which receive the edge portions 26 of the panels. The legs 32 may contact the outer face of the panels directly or indirectly via unshown seals (not shown). A main pair of walls 36 extend inwardly from the central section 34 and define a channel which, when the inner and outer members are assembled together as shown, interfits in telescoping fashion with the channel defined by the walls 30. In the illustrated embodiment, the channel associated with the outer member 16 receives the channel-forming walls 30 associated with the inner member 14; however, the arrangement could be reversed.

The central section 34 is also provided with a housing 38 formed by spaced walls 40 having inwardly directed lips 42 which serve to trap the head(s) of one or more bolts 44. The bolt heads may be introduced through open ends of housing 38 at the ends of the outer member 16. The bolts 44 are of sufficient length to extend inwardly through the channel defined by walls 30 and through and beyond drilled holes in the cross-piece 20 so that the inner and outer members 14, 16 can be coupled together by tightening of a nut 46 threaded on to the inner end of the bolt 44. In this manner, the inner and outer members 14, 16 may be drawn together on opposite sides of the panels 12 to firmly locate the panels and secure good sealing via interposed seals. Usually the inner and outer members will be coupled together by bolt and nut sets 44, 46 at two or more locations along the length of the glazing bar. The seals may co-extruded with the profiles forming inner and outer members 14, 16 or they may be bonded thereto.

It will be observed that, when the roofing structure has been assembled, the fastening means formed by the bolt and nut 44, 46 firmly secure the inner and outer members together and afford effective resistance to the outer member 16 being detached from the inner member 14 merely by levering the outer member upwardly as is readily possible with the plastics connector used in the assembly shown in GB Patent No. 2347963.

In the illustrated embodiment, the bolt head is captive with the outer member 16 while the nut co-operates with the underside of the inner member 14. In a modification, the nut may be captive within the housing 38 and the bolt head may co-operate with the underside of the inner member.

In another modification, the outer member may be provided with an extension corresponding to the housing 38 which projects into close proximity with the cross-piece so that the inner and outer members may be coupled together by a fastener such as a self-tapping screw 60 which engages in, for instance, a suitable aperture provided in the lower end of the extension. This embodiment is illustrated in FIG. 3A.

In a further modification, instead of the outer member being a single component as illustrated in the drawing, it may consist of two components extending laterally and downwardly from opposite sides of the central stem portion 18, in which case the arrangement may be such that the inner member is coupled to one or both of the outer members by a coupling arrangement which is not accessible from the external side of the roofing structure.

Referring to FIG. 4A, the glazing bar 110 may comprises an inner member 114 and an outer member 116 either or both of which may be manufactured as aluminium or plastics extrusions. The inner member 114 is generally T-shaped comprising a central stem portion 118 and a cross-piece 120 which has upwardly directed flanges 122 forming shoulders 124 providing support for the the inner faces at the panel side edges. In its normal position of use, the inner member is inverted with the free end of the stem portion 118 uppermost.

The outer member 116 is generally V-shaped having downwardly directed legs 132 which extend from each side of a central section 134. The legs 132 together with the flanges 122 form openings which receive the side edge portions of the panels. The legs 132 may contact the outer face of the panels via seals 135. The outer member is releasably coupled to the inner member by reception of inward exension 137 which may be bifurcated within a channel 139 at the free end of the stem portion 118. The extension 137 may be integral with the outer member or it may be a separately formed components which is secured to the outer member. The channel 139 may be provided with formations such as internal ribs for co-operation with projections on the extension 137 in order to provide resistance to separation of the outer member 116 from the inner member 114.

Thus far, the glazing bar construction is generally similar to that disclosed in British Patent Application No. 2347963. With such an arrangement, it will be seen that once the outer member is removed by levering it away from the inner member, the side edges of the panels are then free thus enabling the panels to be lifted and allowing entry to be gained by an intruder.

In contrast with the glazing bar construction of British Patent Application No. 2347963, the glazing bar forming the embodiments of FIGS. 5A to 9A of the present invention are each provided with means which, with respect to lifting of the panels, serve to render the panels 112 captive with the inner member 114 in such a way that such means cannot be easily released even after the outer member has been removed.

In FIG. 4A, such means comprise a pair of side edge retainers 140 each of which may be in the form of a plastics or aluminium extrusion. Each retainer 140 comprises a channel 142 defined by base 144 and side walls 146, 148 for receiving a panel side edge as illustrated. Each retainer 140 is designed for assembly to the inner member 114 in such a way that the channel 142 fits within the gap between the inner and outer members with its base 144 proximate the central stem portion 118. The wall 146 has a depending L-shaped leg 150 which extends around one side of the cross-piece 120 for connection, via coupling 152, to the leg 150 of the other retainer. The coupling 152, which may be of a releasable nature, is located on the internal side of the glazing bar and is not therefore accessible from the exterior when the panels 112 are in place. The coupling 152 may take various forms, e.g. it may be in the form of interfitting snap engageable elements associated one with each of the retainers or it may comprise a fastener securing the the two retainers together. Once the two retainers are coupled together and the panel side edges received within the channels 142, it will be seen that each panel (located between a pair of such glazing bars) is rendered captive to the inner member independently of the outer member so far as lifting of the panel is concerned.

The retainers 140 may be assembled to the side edges of each panel 112 prior to placement of the panel on the inner members 114 during construction of the conservatory or like building. The panel plus retainers is positioned on the inner members and the legs 150 of the retainers can be flexed appropriately to allow them to pass over the cross-piece 120 and then brought together secured by the coupling 152. This method of fitting is particularly applicable where the retainers are of an adequately flexible material such as a suitable plastics. An alternative method of assembly involves initially fitting the retainers 40 to the inner member and then registering the panels with the channels 142 at one end of the inner member and sliding the panels into position. Once the panels have been located, the outer members are connected to the inner members by engagement of the extensions 137 with the channels 139.

Each retainer may also co-operate with the outer member if desired in such a way that the outer member is linked to the retainers and hence to the inner member independently of the interconnection afforded by the extension 137 and channel 139. In the embodiment of FIG. 4A and also the other embodiments described below, this may be implemented by the provision of a a flange 154 projecting upwardly from the wall 148 for coupling to the legs 32. Such coupling may for instance comprise interlocking barbs 156, 158 which automatically lock as the outer member is pushed towards the inner member, e.g. so that the barb 156 on the flange 154 slides past and then engages with the barb 158 on the leg 132, this being aided by the ability of the flange 154 to flex resiliently to a sufficient degree. .

In the embodiment of FIG. 4A, the retainers 140 are coupled to each other at the underside of the inner member. However, the manner in which the retainers are located and secured can vary as illustrated by the variants illustrated in FIGS. 6A to 9A which are not to be considered as exhaustive. In FIGS. 6A to 9A, the same reference numerals are used to depict those parts which have counterparts in FIG. 4.

In FIG. 5A, each retainer 140 is held in place by engagement of the L-shaped leg 150 with the underside of the cross-piece 120 rather than by coupling with the other retainer. The engagement between the leg 150 and the cross-piece is obtained by means of formations 160, 162 which are automatically brought into engagement as the retainer is assembled to the inner member with the formation 160 snapping over the formation 162 by virtue of flexing of the end portion of the leg 150. The formations 160 and 162 may be uncoupled from each other by pulling the end portion of the leg 150 away from the cross-piece.

In the embodiment of FIG. 4A, the retainers 140 serve to conceal the inner member 114 and may in addition to their retaining feature also function as a cladding to conceal the inner member on the inner side of the roofing structure. For this purpose, the retainers 140 may be produced as plastics, aluminium or wood sections. In the embodiment of FIG. 5A and other embodiments to be described below, the retainers 140 may only partially conceal the inner member and, if desired, in these embodiments, cladding section or sections additional to the retainers 140 may be provided to conceal the cross-piece 120 may in use be concealed on the internal side of the glazing bar in known fashion, such cladding section(s) being of plastics material, aluminium or wood for example and being attachable to the inner member 114 and/or to the retainers 140. For this purpose, the retainers and cladding section(s) may be provided with means for enabling the cladding section(s) to be secured in place, e.g. by snap engagement. The cladding section(s) may be provided with the seals on which the panels seat.

In FIG. 6A, the legs 150 co-operate with the underside of the flanges forming the shoulders 124. In this case, the coupling of the retainers 140 to the cross-piece 120 may be purely by virtue of the end portions of the legs 150 being trapped below the shoulder-defined flanges or the retainers may be coupled to the cross-piece by a suitable fastening arrangement (not shown). In this embodiment, the gap between the underside of the roofing panels and the shoulders 124 may be taken up by the previously mentioned cladding section(s) and/or seals associated therewith.

In FIG. 7A, instead of depending L-shaped legs, the wall 146 is provided with a projection 161 which engages with a groove in the shoulder 124, e.g as a snap fit. In FIG. 8A, the end portions of the legs 150 (again not L-shaped) are coupled at 162 to the upwardly directed legs 122 of the cross-piece. Such coupling may be by way of snap-engaging features or other fastening arrangements such as self-tapping screws.

As described with reference to the embodiment of FIG. 4A, the retainers 140 in each of the embodiments of FIGS. 5A to 8A may be fitted to the side edges of the panels and then engaged with the inner member on placement of the panels between an adjacent pair of inner members or alternatively the retainers may be fitted to the inner members prior to placement of the panels. In the latter case, placement of the panels may involve registering them with the channels 142 at the eaves ends of the inner members and then sliding the panels upwardly to the desired position.

Referring now to FIG. 9A, a pitched conservatory roof comprises a number of spaced glazing bars (not shown, but which are of the form described with reference to FIGS. 1A to 3A) between which polycarbonate or like roofing panels 210 are supported along their edges. The glazing bars extend between a ridge structure (not shown) and a box section eaves structure 212 which may be manufactured as an aluminium or aluminium alloy extrusion. The panels are supported with their ends overhanging the eaves structure 212 to drain into guttering (not shown). The eaves structure 212 surmounts a side of the conservatory.

Associated with the lower or forward ends of the panels 210 is an end fitting 214 which may be manufactured as a plastics extrusion or a metal extrusion such as an aluminium or aluminium alloy extrusion. The end fitting 214 has at its forward end a channel 216 having a rearwardly directed open mouth for reception of the forward ends of the panels 210. The channel 216 is defined by a base 218 which closes the open end of the polycarbonate panel, a wall 220 which overlies the marginal edges at the lower ends of the panels 210 and a lower wall 222 which underlies the lower end of the panel. In this manner, the end fitting co-operates with the lower panel edges extending between adjacent glazing bars. The wall 222 may serve as a thermal break in that it prevents direct exposure of the overhanging portions of the inner faces of the panels.

The fitting includes a downwardly directed leg 224 which projects laterally from the wall 222, e.g. at an angle of 90 degrees, for engagement with the top wall of the eaves structure 212 so as to act as a fulcrum about which the fitting can tilt or rock about an axis parallel to the axis of elongation of the end fitting (i.e. perpendicular to the plane of the paper as viewed in FIG. 1A) to accommodate the pitch of the roof. The leg 224 also serves as a closure for the gap between the underside of the panel 210 and the top of the eaves structure 212.

An L-section shaped portion 226 extends rearwardly of the leg 224 and includes a laterally projecting limb 228 which is spaced from and extends downwardly in generally parallel relation with the leg 224 for co-operation with the rear of the eaves structure. The limb 228 is intended to be fastened to the eaves structure so as to locate the end fitting 214. To this end, the limb 228 and the rear of the eaves structure may be drilled to receive a self-tapping screw to firmly secure the end fitting in place. It will be noted that the attachment of the end fitting 214 to the eaves structure 212 is located interiorly and cannot be accessed from the exterior when the roof panels are in place.

To facilitate tilting of the end fitting according to requirements, the limb 28 may be provided with a number of forwardly directed projections 230 for co-operation with a flange 232 projecting rearwardly from the eaves structure. As shown in FIG. 9A, the flange 232 is located between the uppermost and intermediate projections 230 but it will be understood that the angle of tilt of the end fitting can be increased by arranging it so that the flange 232 is located between the intermediate and lower projections 230. In the illustrated embodiment, three such projections are provided; by using a larger number of projections and/or a different spacing between adjacent projections, the incremental change in the tilting angle may be modified as desired.

FIG. 10A illustrates a modification in which like parts are depicted by the same reference numerals. In this embodiment, the limb 228 is not provided with projections 230 as in FIG. 9A. In this case, the limb 228 is simply connected, e.g. by means of a screwthreaded fastener, to the eaves structure after it has been tilted to the appropriate angle about the leg 224. In FIG. 10A, it will be noted that the upper wall 220 is downwardly inclined so that insertion of the panel into the channel 216 involves some flexure of the wall 220 which may then bear against the panel. This feature may also be present in the embodiment of FIG. 9A if desired.

FIG. 11A illustrates another modification using the same reference numerals as in FIG. 9A to identify like parts. In this embodiment, the leg 224 terminates in a knuckle-shaped formation 236 which is adapted for reception in a channel 240 of the eaves structure (see FIG. 9A) in such a way that the formation 236 can pivot or rotate in the channel 240 to afford the tilting action necessary to accommodate the pitch of the roof As illustrated, the knuckle 236 and the channel 240 are of part-circular section for this purpose. To facilitate insertion of the knuckle 236 into the channel, it may be hollow and interrupted, as shown at 242, so that it can be deformed sufficiently for insertion as a push fit into the channel 240 and then spring back to its original shape especially where the end fitting is of a plastics material. In other instances, the knuckle 236 may be introduced from one end of the channel 240 and slid to the desired location. As described below with reference to the embodiments of FIGS. 12A to 14A, where the knuckle 236 is push-inserted into the channel 240, a formation or formations may be provided in the vicinity of the entry opening of the channel so as to block withdrawal of the knuckle.

Referring now to FIG. 12A, in this embodiment the end fitting includes a downwardly directed leg 324 which is formed with a spigot 326 which is generally wing-shaped or of arrow head configuration for engagement in a socket 328 located adjacent the forward corner at the top of the eaves structure 212, the arrangement being such that the fitting can tilt or rock about an axis parallel to the axis of elongation of the eaves structure (i.e. perpendicular to the plane of the paper as viewed in FIG. 12A) to accommodate the pitch of the roof. The leg 324 may also serve as a closure for the gap between the underside of the panel 210 and the top of the eaves structure 212.

The spigot 326 comprises a pair of wing portions 330 projecting to either side of the leg 324. Assembly of the spigot 326 to the socket 328 involves push insertion of the spigot 326 through a slot-shaped opening 332 forming the mouth of the socket 328. To this end, the wing portions 330 have some degree of flexibility such that they close up during insertion through the opening 332 and then spring back or restore to the configuration illustrated once fully inserted into the socket. Although the spigot may be readily inserted into the socket, once the parts have been assembled the spigot is then captive against withdrawal through the opening by virtue of expansion of the wing portions 330 to the illustrated configuration. To ensure that withdrawal is blocked, the marginal edges of the opening 332 may be turned inwardly or provided with inwardly projecting lips or other formations which co-operate with the free ends of the wing portions 330 to trap the spigot. In FIG. 12A, these formations are illustrated as nibs 350 which, in the event of any attempt to pull out the spigot 326, co-operate with the free edges of the wing portions 330 to block withdrawal.

In the modification of FIG. 13A, the wing portions are configured so that the spigot 326 is of arrowhead configuration and the marginal edges of the opening 332 are inwardly turned at 334 to co-operate with the wing portions 330 and thereby block withdrawal of the spigot once it has been push inserted into the socket.

In the embodiment of FIG. 14A, the spigot and socket are generally of the same configuration as shown in FIG. 12A but the socket in this case is located partway down the front wall 212A of the eaves structure.

Although the arrangement can be such that the spigot cannot be withdrawn from the socket in a direction tranverse to the longitudinal axis of the eaves structure (at least not without damage to the spigot and/or the socket), it will be appreciated that because the eaves structure is usually an extruded component with the socket extending along the full extent of its length, the end fitting may be uncoupled from the eaves structure by sliding it along the eaves structure to the end of the latter.

In each embodiment, the wall 222 may be provided with spacing elements such as ribs to space the underside of the roof panel from the wall 222 to permit water drainage in the event of water ingress into the channel 216. If desired, the channel, e.g. the wall 222, may be provided with outlet holes to allow drainage of any water into the guttering.

The end fittings in each case will typically be cut to length (from an extruded profile) to correspond with the spacing between adjacent glazing bars, although the possibility of using an end fitting of a length sufficient to span the width of two or more roofing panels is not excluded nor is the possibility of using end fittings which are somewhat narrower than the spacing between adjacent glazing bars.

The ridge structure includes a part which overlies the upper ends of the panels with the consequence that lifting of the upper ends is prevented. If the security afforded by the glazing bars is in some way breached, the use of an end fitting according to the present invention serves to trap the lower end of each panel thereby preventing the lower end of the panel being lifted and a would-be intruder is further hindered by the fact that the fixture of the end fitting is located interiorly and is not therefore accessible without damaging the roofing panel thereby creating noise which could alert others to the intruder's activity.

In a modification of the illustrated embodiments, the end fitting may be provided with a downwardly depending leg located forwardly of the fulcrum and forming a closure or weatherproofing member which covers the gap between the underside of the roofing panels and the forward face of the eaves beam. This is depicted in phantom outline by reference numeral 50 in the embodiment of FIG. 9A but it will be appreciated that it may also be incorporated in other embodiments of the invention. The weatherproofing member 250 may be of a flexible nature so that, regardless of the angle of tilt of the end fitting, it makes sealing contact with a front surface of the eaves beam.

Where the end fitting is fabricated as a metal extrusion, it may incorporate a thermal break between the fulcrum and the remainder of the end fitting, e.g. between the leg 224 or 324 and the lower wall 222.

Eaves Beam and Cill/Framework and Glazing Bar Shoe Features

Referring firstly to FIGS. 1B and 2B, a conservatory in accordance with this aspect of the invention typically comprises a load-bearing wall 100 carrying a cill 102 above which a roof structure 104 is supported with glazed window frames (not shown) located between the cill 102 and an eaves beam 106 (also commonly referred to as the ring beam) of the roof structure. The roof structure comprises a ridge 108 and glazing bars 110 extending between the ridge 108 and sections of the eaves beam which extend around the sides of the conservatory. The glazing bars 110 serve to support roofing panels, e.g. of glass. polycarbonate or polyvinylchloride, extending from the ridge 108 and overhanging the eaves beam sections 106. The eaves beam 106 and the cill 102 each comprise extruded profiles of for example aluminium or an aluminium alloy.

In the embodiment illustrated in FIGS. 11B and 2B, the eaves beam and the cill are each made up of a number of sections cut from the respective extruded profiles and joints between adjacent sections are shown at locations E1, E2 and C1, C2, E1 and C1 being corner joints and E2 and C2 being intermediate joints between in-line sections of the extruded profiles. Typically, in a 3 segment-fronted conservatory design as shown in FIGS. 1B and 2B, the internal angles at joints E1 and C1 will be about 135°. Where the design is a 5 segment-fronted conservatory, the internal angles at joints E1, C1 will be about or 150°. In a design such as that shown in FIG. 3B, the eaves beam and cill joints may be of the in-line type corresponding to E2, C2 and the corner joints may be right angled.

Currently the practice is to produce the joints by mitring the adjacent sections of the extruded profiles forming the eaves beam and the cill, which is time consuming and requires a significant degree of accuracy in cutting if well-fitting joints are to be achieved. For this reason, the sections of the extruded profiles are usually cut to size and mitred off-site and then delivered to the construction site. Also, in current designs, the weight of the roof structure is largely transmitted from the eaves beam to the cill and hence to the load-bearing wall 100 through the glazed window frames which are often fabricated from extruded PVC profiles. In accordance with the present invention, mitring of the joints between the adjacent sections of the extruded profiles is eliminated by employing separate connectors which provide the corner joints or in-line joints of the eaves beam and/or the cill and "squaring off" the ends of the extruded profiles by cutting them substantially at right angles to the length of the profile.

One example of a corner connector for the joints E1 in the eaves beam structure is shown in FIG. 4B and will be seen to comprise a block 120 having inner and outer faces 122 and 124 corresponding to the angle of the joint and side faces 126 which are angularly related so as to conform with the angle required. For example, the faces 126 of the block may be at an angle of 135 or 150° relative to each other. Each face 126 is provided with a projection 128 which is configured to interfit with the eaves beam profile.

As shown in FIG. 4B, the projections 128 are of generally square configuration and, as such, are appropriate for insertion into an eaves beam profile including a corresponding cross-section. However, it will be understood that the internal cross-sectional shape of the eaves beam profile may take a wide variety of forms and that the projections 128 may be configured accordingly to match. When so fitted, the ends proper of the eaves beam profile will be brought into abutment with those areas of the side faces 126 surrounding the projections 128 to afford a tight joint between the profiled section and the face 126. After the connector has been fitted with the eaves beam section to be interconnected, suitable fasteners may be used to secure the eaves beam sections to the connector. The connector may be provided with pre-drilled holes for the purpose, e.g. for receiving self-tapping screws.

FIG. 5B illustrates an in-line connector for use in making a joint E2, the connector comprising a central portion 130 having a front face 132 which is intended to be flush with the eaves beam sections on each side thereof. Projections 134 extend from each side of the central portion 130 for intermitting with the internal profile of the eaves beam sections. Each projection 134 may be provided with pre-drilled holes 135 for reception of fasteners, e.g. self-tapping screws, for securing the eaves beam sections to the connector.

FIG. 6B illustrates a connector suitable for making right angled joints between adjacent eaves beam sections. In this case, the connector comprises a block 140 of generally cuboidal configuration having outer faces 142 (one only shown) which are right angles to one another and are intended to be flush with the eaves beam sections and sides faces 144, also at right angles to each other, provided with projections 146 for interfitting with the eaves beam sections in the manner described above in relation to the connector of FIG. 4B.

In each of the connector embodiments shown in FIGS. 4B to 6B, means 160 is provided for providing a tiltable connection between the lower ends of the glazing bars 110 and the eaves structure so as to allow the pitch of the roof to be adjusted during installation. The tiltable connection may take various forms including a tiltable or pivotable bolt arrangement of the kind disclosed for instance in British Patent Application No. 2347963, i.e. where the head of the bolt is received within a channel in the eaves beam structure and is designed to permit tilting of the associated glazing bar. The means 160 may comprise a channel 162 for reception of the tiltable component so that the tiltable component is captive with the connector and may be adjusted slidably lengthwise of the channel.

Alternatively, instead of a tiltable bolt arrangement, the tiltable connection may be achieved by means of glazing bar-mounting shoes as will described further later. In the case of the corner connectors of FIGS. 4B and 6B, the channel 162 extends generally horizontally and perpendicularly with respect to the bisector between the side faces of the connector block. The connector blocks in each case may be substantially symmetric with respect to a vertical plane normal to the length of the channel 162.

The connector embodiments of FIGS. 4B to 6B are also designed for the purpose of controlling the load-bearing characteristics of the conservatory framework and, in particular, to ensure that the window frames are largely relieved of load-bearing duties so far as the weight of the roof structure is concerned. In particular, the connectors of FIGS. 4B to 6B are designed to co-operate with vertical load-transmitting members 164 which transmit the weight of the roof structure from the eaves beam to the load-bearing wall 100 thereby substantially by-passing the window frames. These load-transmitting members 164 are primarily located at the corners of the conservatory framework but, particularly where the framework involves relatively long spans of the eaves beam with the attendant possibility of "sagging", they may also be located intermediate the corners by inclusion of the in-line connectors of FIG. 5B in the eaves beam structure. In a modification, the load-transmitting members 164 may be arranged to transfer the weight of the roof directly to ground level rather than to the wall 100.

Each connector is provided with a formation which interengages with the load-transmitting members 164. For example, where the load-transmitting members are in the form of posts, the connectors may be provided with recesses 166 (not shown in FIG. 5B) having a configuration generally complementary to the outer periphery of the posts and opening at the bottom face of the blocks. In this case, the top portions of the posts are received in the recesses so as to abut with the bases of the recesses 166. In a modification, at least the top portions of the load-transmitting members may be hollow so as to receive a projection provided on the bottom walls of the connectors.

Cill corner connectors are illustrated in FIGS. 7B and 8B. The cill extruded profile is typically of the conventional box section configuration corresponding to the cross-sections of the connectors in FIGS. 7B and 8B. The connector 180 of FIG. 7B is of the type used for example for a standard 135 or 150° corner between adjacent cill sections and is dimensioned for reception of the ends of the cill sections thereby concealing the end proper of each cill section which does not therefore need to be mitred and may simply be squared off. Once the cill sections have been engaged with the connectors 180, they may be secured in place by affixing them to the top of the wall 100. The cill connector 182 of FIG. 8B is generally the same as that of FIG. 7B except that the angle in this case is 90°. In addition to the corner connectors 180, 182, in-line cill connectors (not shown) may be provided which comprise a straight length having a profile corresponding to the corner connectors of FIGS. 7B and 8B. The in-line cill connectors may be used in conjunction with the in-line connectors for the eaves structure.

The cill connectors as described above interfit with the cill sections by insertion of the ends of the latter within their interiors. However, the possibility of the cill connectors having portions which insert into the ends of the cill sections is not excluded. In this case, the cill connectors may have a central portion which is exposed and substantially flush with the cill sections.

As in the case of the connectors for the eaves structure, each of the cill connectors is adapted for co-operation with the substantially vertical load-transmitting members 164, in particular the bottom ends of the latter, so that the weight of the roof structure is transmitted to the load-bearing wall 100 thereby largely by-passing the window frames. The bottom ends of the members 164 may seat on the top walls of the cill connectors in which case the cill connectors will be provided with means for registry with and location of the bottom ends of the members 164. Alternatively, as illustrated in FIGS. 7B and 8B, the arrangement may be such that the top wall 190 of the cill connectors is relieved of load-carrying duties, e.g. by forming the top walls 190 with an aperture 192 through which the members 164 extend for engagement with the bottom wall which seats on the load-bearing wall 100. If desired, the bottom walls may also be apertured so that the members 164 extend through the cill connectors and seat directly on the wall 100.

The eaves beam connectors and the cill connectors may be produced as plastics mouldings, e.g. polypropylene or nylon, or they may be fabricated from other materials such as aluminium or aluminium alloy.

Reverting now to the mounting of the glazing bars 110, FIG. 9B illustrates one form of mounting shoe for co-operation with the channels 162 associated with the eaves structure connectors of the present invention and with corresponding channels associated with the eaves beams themselves. One form of eaves beam profile is illustrated in FIG. 13B by way of example. It will be understood that where the eaves beam profile is as shown in FIG. 13B, the projections of the corner and in-line connectors will be adapted to match the internal profile of the eaves beam.

As shown in FIG. 10B, the glazing bars 110 comprise an inner member 28 and an outer member (not shown) attachable to the inner member. The glazing bar construction may be of any of the forms disclosed herein.

The inner member 24 is T-shaped and comprises a cross-piece 26 and a central stem 28 which terminates at its upper end in a channel 30 by means of which the outer member may be attached to the inner member, e.g. in the manner disclosed in the above mentioned prior British Applications. The cross-piece 26 may be provided with cladding (not shown) to conceal the inner member on the inner side of the roof. Once the outer members have been assembled to the inner members of the glazing bars, the roofing panels are trapped between the inner and outer members in the manner disclosed in the prior British Applications.

In constructing the roof, the glazing bars are coupled at their lower ends to the eaves structure in a tiltable manner to accommodate the pitch of the roof, such coupling being effected by means of glazing bar mounting shoes 10 (see FIG. 9B) which are designed to be mounted tiltably on the eaves structure or on the eaves beam connectors and engage with the glazing bars in such a way that one component inserts or nests within the other in telescopic fashion and locates the glazing bars relative to the eaves structure without requiring any fastening, at least not initially. In this manner, instead of having to fasten the glazing bars while holding them up in the air, after the shoes have been initially engaged with the eaves structure, the installer can then engage sufficient glazing bars with respective shoes to support the ridge structure without having to effect permanent securement of the glazing bars to the eaves structure at that stage.

As shown in FIG. 10B, each shoe may comprise a channel-section 40 having a base 42, sides walls 44 and inwardly projecting flanges 46 bounding the mouth of the channel. One end of the channel is closed by stop plate 48 and the opposite end is open. The lower end portion of the glazing bar (of which only the inner member 24 is illustrated) inserts slidably into the channel 40 with the cross-piece 26 received as a close fit within the channel and with the stem 28 of the T projecting through the open mouth of the channel. The flanges 46 serve to trap the cross-piece 26 within the shoe. The fit may be sufficiently close (e.g. an interference fit) that adequate resistance to withdrawal of the glazing bar is provided to prevent the glazing bar accidentally falling out of the shoe once inserted. Intially only the inner member 24 of the glazing bar is engaged with the shoe. The outer member is assembled after the roofing panels have been put in place.

The base of the channel 40 acts as cladding for the lower end portion of the inner member 24, the remaining length being clad by for example plastics cladding extending along the inner face of the glazing bar substantially from the shoe to the ridge. The stop plate 48 as well as limiting the extent to which the glazing bar can be inserted, also serves as an end closure for the glazing bar thereby obviating the need for a separate end closure. If desired, the stop plate 48 may be provided with a projection (not shown) for co-operation with the outer member to prevent the latter being lifted at that point by a would-be intruder attempting to gain access through the roof by removing the roofing panels.

At its underside, the shoe 10 is provided with a downwardly directed projection which terminates in a portion 50 which co-operates with the eaves beam directly or the eaves beam connectors to allow the shoe and hence the glazing bar to tilt in the direction depicted by reference A according to the desired pitch of the roof. For this purpose, the profile of the eaves beam or the eaves beam connectors includes a channel 162 for reception of the portion 50 so as to allow such tilting to occur. In the embodiment of FIG. 10B, the portion 50 may be generally cylindrical or spherical (at least in part) and the channel 162 is of generally complementary curvature. The portion 50 may be insertable through the open mouth of the channel 162 in which case the portion 50 may be resiliently deformable to allow this. Alternatively the portion 50 may be inserted from one open end of the channel 162. In both instances, the intergagement between the portion 50 and the channel is such that the shoe may slide lengthwise of the eaves beam or connector to enable it to be positioned in any desired location.

FIGS. 11B and 12B illustrate modified forms of the shoe in both of which the channel-section 40 of slightly different configuration to that of FIGS. 9B and 10B but is again designed for reception of the glazing bar by sliding insertion as a close fit. Also both of these embodiments include strengthening or bracing plates 54 securing the upper part of the stop plate 48 to the shoe and a projection 56 for co-operation with the outer member of the glazing bar to prevent it being lifted away from the inner member in the vicinity of the shoe. For instance, the projection 56 may be arranged to overlie the outer member for this purpose.

The bracing plates may in addition to affording reinforcement for the end stop 48 also serve to locate fastening means for securing the shoe to the glazing bar. For example, the bracing plates 54 and the central stem 28 of the inner member 24 may be drilled to receive a bolt to couple the stem to the bracing plates.

In FIG. 11B, the shoe is provided with a tilting portion 50 of generally cylindrical configuration whereas in FIG. 4B, it is provided with tilting portion 50 in the form of a curved cup-shaped section which is downwardly convex for co-operation with the channel 162. In each of the illustrated embodiments, the shoe may comprise a plastics moulding, e.g. a single piece moulding, of suitable material such as polypropylene. Alternatively, it may be fabricated from other materials such as aluminium or other metal.

In FIGS. 1B to 3B only the forward end of the conservatory is shown. Typically the rearward end will be located against a wall, e.g. the wall of a building such as a house to which the conservatory is attached. At the rearward end, the eaves beams and the cills on each side of the conservatory may terminate in end connectors which may be similar to those used in-line connectors except that only one projection need be provided for registry with the eaves beam or cill profile. Thus, for example, at the rearward end of the conservatory, an arrangement such as that shown in FIG. 14B may be employed. Referring to FIG. 14B, the eaves beam end connector comprises a block 200 of generally cuboidal configuration adapted at one side thereof for registry with the end of eaves beam. More specifically, the block 200 is provided on one face 201 thereof with a projection 202 which interfits with the eaves beam either with the internal profile or the external profile of the latter. Thus, for example, the projection 202 may be configured generally to match the internal profile of the eaves beam and that end of the eaves beam may be squared off so that it buts tightly against the face 201. The block 200 is also provided with a channel 162 for use in tiltably mounting a glazing bar, e.g. by way of a bar-mounting shoe or a tiltable bolt arrangement in the manner previously described. The lower face of the block 200 is coupled to a generally vertical load-transmitting post 204; for example, by reception in a recess (not shown) opening at the lower face.

The cill end connector 206 has a configuration which generally matches that of the cill profile and interfits with the end of the cill either with the internal profile or the external profile of the latter. For example, the cill end connector 206 may be dimensioned to receive the cill or it may be shaped to insert into the cill profile. An aperture 208 is provided in the connector 206 for location of the post 204 to allow for load transfer to the wall 100 or to ground level.

In use, the post 204 may be secured by any suitable means to the wall of the house against which the rear end of the conservatory is located. The arrangement may be such that the post 204 transmits the weight of the roof to the wall of the house or the securing arrangment may be such that it transmits the load to the wall 100 or to ground level.

In the foregoing description with reference to the drawings, the eaves beam and the cill have closed profiles, e.g. box-type sections. However, the possibility of their having "open" profiles (i.e. a profile which does not enclose a space on all sides) is not excluded.

The connectors disclosed herein may be used in conjunction with the any one of the arrangements disclosed in the present application.

Coupling of Ridge Cap to Ridge Structure

Referring to the FIGS. 1C to 5C, the ridge of a conservatory roof comprises a main ridge structure 10 from which glazing bars 12 extend towards an eaves structure (not shown). The glazing bars support roofing panels 14. The ridge structure 10 is surmounted by a ridge cap 16 having a central section 18 bordered on each side by a flange 20 which overlies the glazing bars and roofing panels. At its underside, the central section 18 is provided with a channel 22 comprising side walls 24 and inwardly directed lips 26 defining a slot 28 extending lengthwise of the cap. The channel 22 is bordered on each side by depending spaced legs 30 which, when the cap is located in place on the ridge structure, receive upstands 32 projecting from the ridge structure.

The cap 16 is secured in place from the interior of the conservatory during the construction process by means of a number of flexible ties 34 which may be made of a suitable plastics material having sufficient strength for the intended purpose. This may be done from beneath the roof, e.g. after roofing panels have been fitted to one side of the ridge. The cap can then be left to rest on that side of the roof while the remaining roof panels are fitted.

Each tie comprises a main shank 36 terminating at its upper end in an enlarged portion 38 for engagement within the channel 22 in the manner illustrated in FIG. 2. Over part of its length, the tie is provided with a region 40 provided with ratchet formations for co-operation with the teeth 42 of a locking member 44. The locking member 44 is retained on the tie 34 by an annular shoulder 48 at the lower end of the tie over which the locking member can be pushed once the tie has been coupled to the cap and inserted through apertures in the ridge structure.

The enlarged portion 38 is designed to be contractible in one direction so that it can be push-inserted through the slot 28 and then expand to retain the tie engaged within the channel 22. In the illustrated embodiment, the enlarged portion 38 is generally of arrowhead configuration having wings 50 which project laterally so that they can deflect inwardly as the enlarged portion 38 is pushed through the slot 28. Once the wings are fully within the channel 28, they can return to their unstressed configuration in which the ends of the wings 50 seat on the inner faces of the lips 26 and prevent uncoupling of the ties from the cap.

In use, the ties 34 are coupled in the manner described above to the ridge cap 16 at spaced intervals along the length of the cap and are inserted through apertures in the ridge structure 10 so as to project below the latter. The ties are made sufficiently long that their lower ends can be gripped from below the ridge structure even when the cap is not in position, e.g. when the cap is laid to one side of the peak of the ridge after fitting of the roofing panels at one side of the ridge and before fitting the remaining roof panels. Once the panels have been put in position, the cap can then be moved to the correct location as shown in FIG. 1C without the need for the installer to get on to the roof since the cap is already coupled (loosely) to the ridge structure and can simply be located in the correct position by manipulation from one end of the conservatory without getting on the roof. Because the ties have already been coupled to the cap and their ends are accessible from beneath the roof, it is then simply a matter of pushing the locking members 44 upwardly along the ratcheted section and into engagement with the underside of the ridge structure 10 while pulling the ties downwardly to tension them. In this way, the locking members 44 can be secure the cap firmly in place. After this has been done, any excess length of tie may be cut off or tucked away out of sight.

The locking member 44 may, if desired, be arranged so that it can be retracted back along the tie towards the lower end of the latter to release the tie. For example, the locking member may have a pawl or pawls adapted to engage the ratchet members and means for moving the pawls to an inoperative state to allow such retraction of the locking member. Alternatively, the ratchet formations may extend over only part of the periphery of the in such a way that the teeth of the locking member coact with the ratchet formations when the locking member is in one orientation but are clear of the ratchet formations to allow retraction when the locking member is in a second orientation. Movement between the two orientations may, for instance, involve rotating the locking member through 90 degrees.

In a modification, instead of the enlarged portion being contractible to allow it to enter the channel 22, it may be dimensioned so that, in one orientation, it will pass through the slot 28 but when turned through 90 degrees, it is then trapped within the channel.

Whilst endeavouring in the foregoing specification to draw attention to those features of the invention believed to be of particular importance, it should be understood that the Applicant claims protection in respect of any patentable feature or combination of features disclosed herein and/or shown in the drawings whether or not those features are described in relation to the same embodiment or in relation to different embodiments and whether or not particular emphasis has been placed on such feature or features.

What is claimed is:

1. A ridge end assembly for a hipped roof comprising a ridge end provided with a mounting element, a number of panel-supporting members radiating from the mounting element at diverging angles relative to each other, a panel supported between each pair of panel-supporting members, a ridge end cap partly overlying and spaced from the panels and a length of sealing material in strip form extending transverse to the panel-supporting members, the sealing material bridging a gap between each panel and the overlying ridge end cap, each supporting member being connected to the mounting element by a separate connector and each connector being provided with a seal locator for locating the strip of sealing material such that a strip width bridges said gap with one edge contacting the panel and the opposite edge contacting or in close proximity to the overlying ridge end cap.

2. An assembly as claimed in claim 1 in which the seal locator forms part of the connector.

3. An assembly as claimed in claim 1 in which the seal locator is provided on a separate component which is adapted to be fitted to the connector.

4. An assembly as claimed in claim 1 in which the seal locator is formed by spaced flanges which extend substantially transversely to the connector on which the seal locator is located, the flanges being arranged so that a section of the sealing material can be inserted in and retained in position by the flanges.

5. An assembly as claimed in claim 4 in which at least one of the flanges is provided with an upstanding flexible sealing gasket for engaging an underside of the overlying ridge end cap.

6. An assembly as claimed in claim 4 in which at least one of the flanges and a lateral extension are integrally formed with each of the connectors.

7. An assembly as claimed in claim 1 in which each of the panel-supporting member has a panel-supporting member drainage channel and each of the connectors is provided with one or more connector drainage channels for directing any water to the panel-supporting member channels associated with the panel-supporting members.

8. An assembly as claimed in claim 7 in which each of the connector drainage channels is integrally formed directly on one of the connectors.

9. An assembly as claimed in claim 8 in which each of the connector drainage channels is formed by a lateral extension of each of the connectors, and wherein the panels are partially supported on the lateral extensions.

10. An assembly as claimed in claim 9 in which the extensions are provided with gaskets for sealing contact with undersides of the panels.

11. An assembly as claimed in claim 7 in which each of the connector drainage channels is a separate component that is fitted to the connector.

12. A ridge end assembly for a hipped roof comprising a longitudinally extending ridge member having a mounting element located at one end;

a plurality of panel-supporting members extending from the mounting element at an angle relative to the ridge member and diverging relative to each other;

a plurality of connectors, each of the connectors mounted to an end of one of the panel-supporting members and connected to the mounting element of the ridge member;

a panel supported between each pair of panel-supporting members;

a ridge end cap mounted to the ridge end of the ridge member and partly overlying and spaced from the panels;

a plurality of seal locators, each of the seal locators mounted to one of the connectors; and a length of sealing material in strip form bridging a gap between each panel and the overlying ridge end cap, the sealing material having a lower edge retained by the seal locators and an upper edge contacting an underside surface of the ridge end cap, the sealing material extending transverse to the panel-supporting members.

13. An assembly as claimed in claim 12, wherein the upper edge of the sealing material contacts the underside of the ridge end cap adjacent a lower edge of the ridge end cap.

14. An assembly as claimed in claim 12, wherein the seal locator comprises spaced flanges that extend substantially transversely to the connector, the flanges being arranged so that a section of the sealing material can be inserted in and retained in position by the flanges.

15. An assembly as claimed in claim 14, wherein at least one of the flanges is provided with an upstanding flexible sealing gasket that engages the underside of the ridge end cap.

16. An assembly as claimed in claim 12, further comprising:

a panel-supporting member drainage channel extending along a length of each of the panel-supporting members; and a connector drainage channel extending along each of the connectors and registering with one of the panel-supporting member drainage channels.

17. An assembly as claimed in claim 12, further comprising:

a lateral extension extending from one side of each of the connectors;

a drainage channel located on each of the lateral extensions; and wherein one of the panels is partially supported on the lateral extension.

* * * * *